United States Patent [19]

Williams

[11] 4,037,370

[45] July 26, 1977

[54] CARTON CLOSING AND SEALING APPARATUS

[75] Inventor: E. Alan Williams, Saratoga, Calif.

[73] Assignee: Nolex Corporation, Los Angeles, Calif.

[21] Appl. No.: 628,443

[22] Filed: Nov. 3, 1975

[51] Int. Cl.[2] ..... B65B 7/16

[52] U.S. Cl. ..... 53/375; 53/388; 93/44.1 R; 156/497

[58] Field of Search ..... 53/29, 38, 39, 47, 186, 53/266, 282, 374, 375, 376, 387, 388; 93/39.1 P, 44.1 R, 55.1 P; 156/69, 497

[56] References Cited

U.S. PATENT DOCUMENTS

| | | | |
|---|---|---|---|
| 2,391,708 | 12/1945 | Johnson et al. | 53/375 |
| 2,425,062 | 8/1947 | Johnson | 53/375 |
| 2,654,981 | 10/1953 | Stenger | 53/376 X |
| 3,137,112 | 6/1964 | Kulleseid | 53/376 |
| 3,823,306 | 7/1974 | Davis | 53/375 X |

*Primary Examiner*—Robert Louis Spruill

[57] ABSTRACT

An apparatus for sealing liquid-tight a liquid filled carton, having at its open end a cover attached to the body of the carton so as to be pressed down upon and adhesively secured to sealing flaps attached to the body of the carton at its open end, has a conveyor for bringing filled cartons into registry with carton sealing assemblies each of which includes a pair of pivotally mounted arms for firmly clasping the carton in substantially complete contacting encompassment over a portion of its length immediately below the open top, and also includes a pivotally mounted plate for pushing the cover down into contact with the sealing flaps. The paperboard of which the carton is formed is preferably coated with polyethylene, and after the carton has been firmly clasped it is transported by the conveyor past a heat source which melts the polyethylene on the areas that are to be sealed together. Immediately after the heating of the polyethylene the pivotally mounted plate clamps down upon the carton cover pressing it firmly into engagement with the sealing flaps. The carton is next transported through a cooling duct, the cover remaining clamped down by the pivoted plate. When the carton emerges from the cooling duct the pivoted plate is raised, the clasping arms are retracted and the filled and sealed carton is discharged from the conveyor.

37 Claims, 29 Drawing Figures

50
52
74
76
62
266
68
17
78
382
54
112
110
111
113
132-3
130-2
132-2
130-3
136
130-1
130
132-1
132
318
64
66
31
532
522
530

FIG. 10.
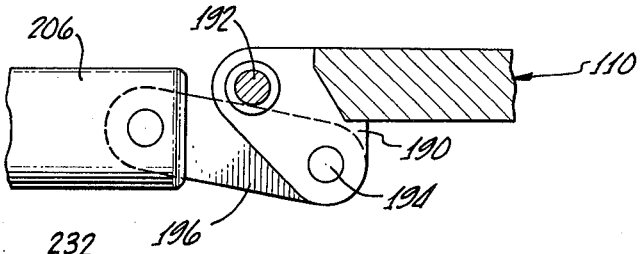
FIG. 11.
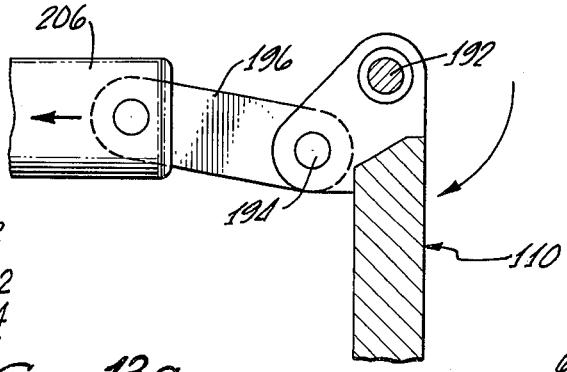
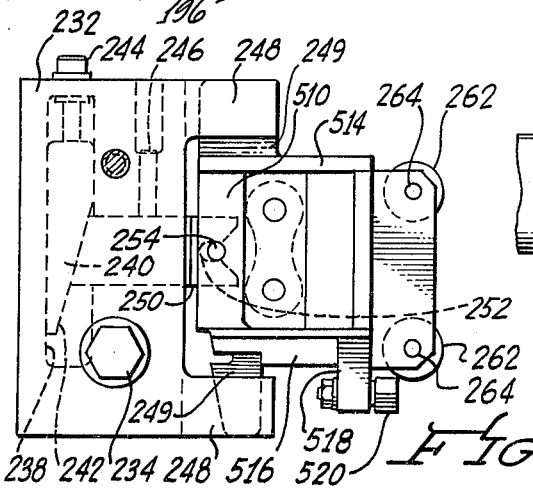
FIG. 13a.
FIG. 12.
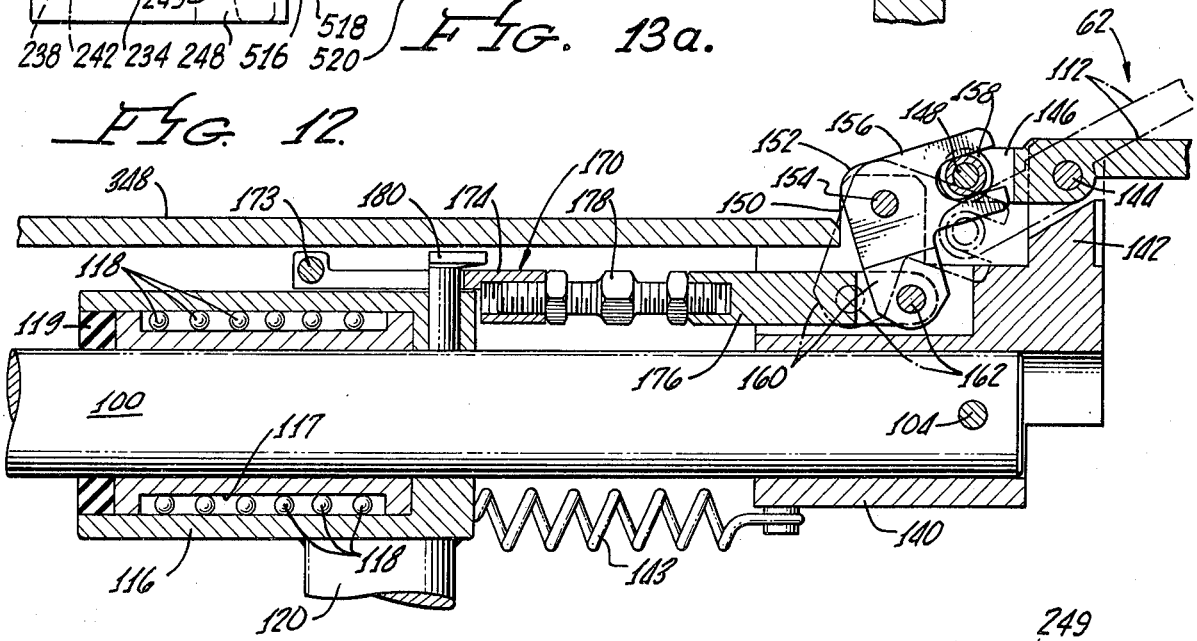
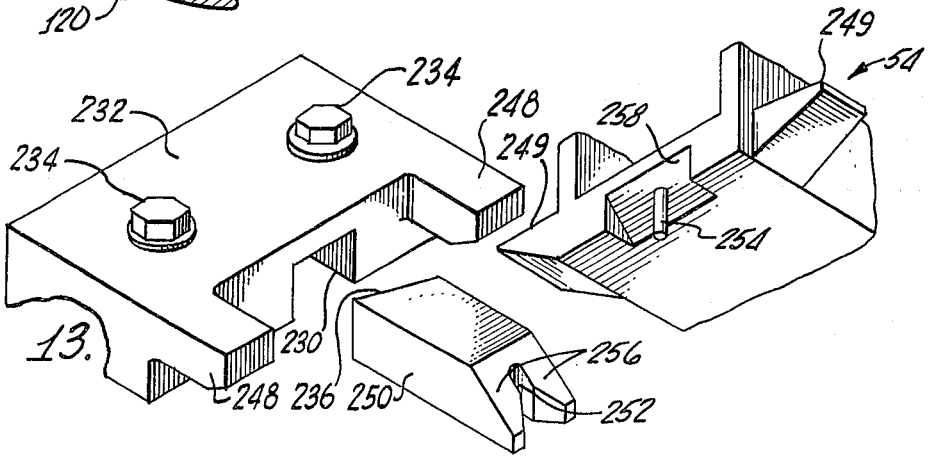
FIG. 13.

CARTON CLOSING AND SEALING APPARATUS

BACKGROUND OF THE INVENTION

U.S. Pat. No. 3,800,677 granted Apr. 2, 1974 to Charles W. Jones and Dwight L. Stetler discloses apparatus for forming, and U.S. Pat. No. 3,775,943 granted Dec. 4, 1973 to Charles W. Jones discloses apparatus for filling with liquid and sealing, a carton of the type that the apparatus to be described hereinafter is intended to seal after having been filled. The carton itself is generally of the type shown in U.S. Pat. No. 3,749,300 granted July 31, 1973 to Charles W. Jones. It is a carton of rectangular cross section, preferably formed from a T-shaped blank of polyethylene coated paperboard. The T-shaped blank provides four side wall panels. An end one of the side walls has integral therewith two end cover or caps which, after the blank has been formed into a tube of rectangular cross section, are folded down upon and sealed to the open ends of the tube. As shown in U.S. Pat. No. 3,800,677 the carton blank is provided on one of its sides with an access flap to which is attached on the inside of the carton a straw or sipper, and the liquid contents of the carton may be consumed by lifting the access flap thereby exposing an end of the sipper from which the contents of the carton may be drawn into the mouth. In the formation of the carton by the apparatus shown in U.S. Pat. No. 3,800,677 both ends of the carton are closed and sealed prior to the filling of the carton, and in accordance with the disclosure of U.S. Pat. No. 3,775,943 the access flap is lifted and the cartons are filled through the access aperture, after which the aperture is sealed by the application of a length of tape covering the access flap which has been pressed back down into the access aperture.

It is a more conventional practice to fill containers for liquids, whether of paperboard, metal or glass, from the top, and container filling machines of this type are known in the art. Heretofore cartons for marketing beverage types of liquids have been for the most part one or the other of two types. One of these, which has a generally flat bottom and top, which enables them to be stacked, consists of four separate component parts. These parts are an open ended tubular body, two end closure members which are crimped upon and adhesively interengaged with the ends of the tubular body and a closure cap that is liftably attached to one of the end members and that squeezes down into and closes an access orifice in that member. The production of such a carton is rendered complex by the necessity for handling and sealing together the several component parts.

The other type of carton is derived from a one-piece blank of sheet stock comprised of four side wall panels that may be folded around to form an open ended tube. Each side wall panel has at each end a closure flap component, each such component being generally rectangular and having an area at least equal to and in some instances exceeding one-half the area of the cross section of the tubular portion. Those that form the bottom of the carton fold in on one another with considerable superposition of flaps so that the bottom of the carton is comprised of several thicknesses of paperboard but is flat. At the top of the carton two opposite ones of the top closure flaps have scorings which delineate a multiplicity of triangles. After the filling of the carton two of the flaps are folded in and bent upon the scoring lines delineating the triangles and the other two are brought together not in flat overlapping relation but in an upward slope of both sides with marginal portions at their edges brought together upstanding and in abutting relation. These may be sealed together by melting the polyethylene coatings and without the use of a mandrel, but the heat for melting the polyethylene must penetrate superimposed layers of paper stock in order to reach the innermost polyethylene coatings and considerably more heat must be applied than is required when it can be applied directly to the surfaces to be sealed together. Also, the upper end of the carton slopes from the center toward two sides of the carton resembling a roof with a central ridge, and the filled cartons are not adapted to being stacked for packing and shipping.

SUMMARY OF THE INVENTION

The present invention provides for the closure and sealing of a liquid-filled carton which has attached to its upper end a closure panel or cover member that is to be pressed down flat upon the open end of the filled carton and sealed thereto by the melting of a polyethylene coating on the inner surface of the closure panel and on the top of the open ended carton, this being accomplished without the utilization of a mandrel.

In a preferred embodiment of the invention the filled cartons are transported from the carton filling machine to pass around a carousel-like structure which carries on its periphery a plurality of carton closing and sealing assemblies. Each of these assemblies comprises a pair of pivotally supported arms for clasping the carton and a pivotally mounted carton closure panel depressing plate. As each carton carrier on the conveyor brings a filled carton into registry with one of the carton closing and sealing assemblies on the carousel the pivoted arms are moved into clasping association with the carton and they clasp it in substantially complete contacting encompassment over a substantial portion of its length immediately below the top of the carton. Also the carton closure panel depressing plate moves pivotally downwardly a part of the distance from its fully retracted position to its full closure panel clamping position in readiness for the melting of the polyethylene on the inside of the cover and at the top of the carton by heat. With the arms thus clasping the carton and the closure panel held by the closure panel depressing plate the conveyor carries the carton past the nozzle of a burner where heat is forced into contact with the inner surface of the cover and the top of the carton to melt the polyethylene. Immediately after the carton has completed its traversal of the burner nozzle the carton closure cover depressing plate rocks down the remainder of its distance of travel to press the carton cover down into positive engagement with inwardly directed sealing tabs carried by the sides of the carton. The carton clasping arms firmly grip the outer surfaces of the carton and hold the carton walls firmly to accept the pressure of the cover depressing plate without the occurrence of any crushing of the walls of the carton.

Immediately after the carton closure panel has been clamped down upon the upper end of the carton the carton closing and sealing assembly, continuing its travel around the carousel, with the carton supported by the carton carrier on the conveyor and clasped and its cover clamped down by the closing and sealing assembly, enters a cooling duct into which air at room temperature is blown. Thus the carton closing and sealing assembly itself, which becomes heated to some extent as the carton traverses the burner nozzle, is cooled and the upper end of the carton is also cooled. The cover depressing plate remains in its fully operated position, clamping the carton cover down upon the end of the carton, during the entire traversal of the cooling duct. After the sealed carton emerges from the cooling duct the carton cover depressing plate is lifted, the carton clasping arms are swung away and the conveyor carries the filled and sealed carton away from association with the carousel and to a position where the carton is removed from the carton carrier either directly at a packing station or is transferred to another conveyor which will carry it to a packing station.

DESCRIPTION OF THE DRAWINGS

For a complete understanding of the invention reference may be had to the following detailed description to be interpreted in the light of the accompanying drawings wherein:

FIG. 10 is a horizontal sectional view taken generally on the line 10—10 of FIG. 8;

FIG. 11 is a horizontal sectional view taken generally on the line 11—11 of FIG. 9;

FIG. 12 is a vertical sectional view taken generally on the line 12—12 of FIG. 6;

FIG. 13 is an exploded perspective view generally along the line 13—13 in FIG. 5 viewing upwardly and downwardly;

FIG. 13A is a plan view taken generally on the line 13A—13A in FIG. 5;

DETAILED DESCRIPTION

Figure 1:
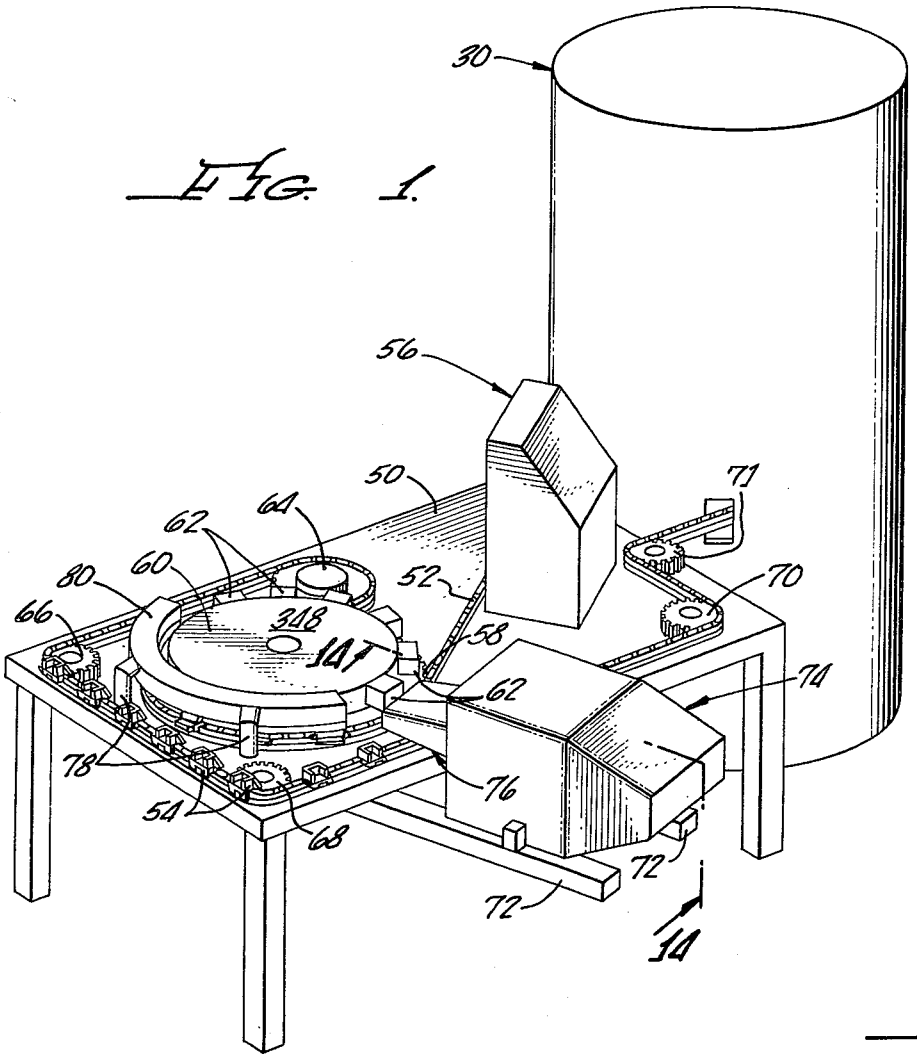
FIG. 1 is a schematic perspective view showing a preferred embodiment of a carton closing and sealing apparatus in accordance with the present invention.

Referring now to the drawings and particularly to FIG. 1, which is a schematic perspective intended primarily to show the principal components of a preferred embodiment of the invention and their relationships to one another from a space standpoint, there is shown, with the identifying reference numeral 30, a cylindrical body which is representative of a container filling machine for filling the cartons with liquids, such as milk or fruit juice, but it is not limited to utilization for filling the cartons with potable liquids. A container filling machine which may be used as the filling machine represented by the reference numeral 30 is disclosed in U.S. Pat. No. 3,456,419, granted July 22, 1969 to Leslie Vadas and Robert W. Drake. The manner in which empty cartons are supplied to the filling machine 30, and apparatus for supplying empty cartons to the filling machine, form no part of the present invention.

THE CARTON

Figure 2:
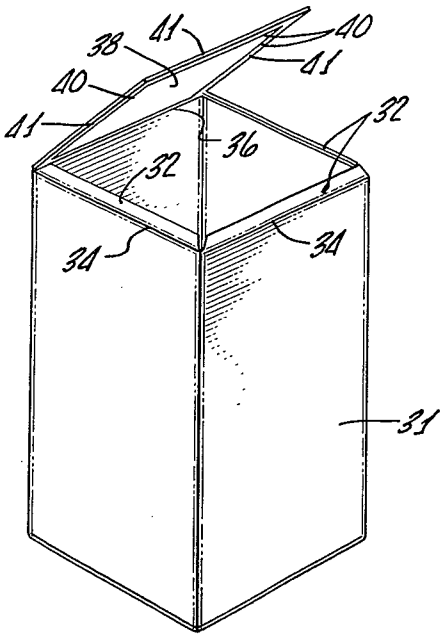
FIG. 2 is a perspective view showing a type of carton that the apparatus in FIG. 1 is adapted to close and seal.

FIG. 2 is a perspective view of a carton of the type that the equipment shown in FIG. 1 is adapted to close and seal. The carton, the blank from which it is formed and the method of sealing it are the subject of copending application Ser. No. 628,444, filed by Mitchel J. Matovich, Jr. on the same day as the present application and assigned to the same assignee. FIG. 2 is not a full scale representation of a carton but it is greatly out of proportion relative to the apparatus in FIG. 1. The carton, designated by the reference numeral 31, is preferably of rectangular cross section as shown, and it may be square. Three of its four walls have integral therewith at the upper ends the narrow sealing flaps or tabs 32, delineated by indentation or scoring lines 34 along which the sealing tabs 32 may be bent inwardly from the walls of the carton to serve as the carton top components upon which a closure panel or cover is to be closed and sealed. The fourth wall of the carton 31 has integral therewith, and also delineated by an indentation or scoring line 36, the carton closure panel or cover 38. It has substantially the same dimensions as the cross-sectional dimensions of the carton 31 and for the achievement of a fully effective seal the portion bounded by the lines 40 which marginally parallel the free edges of the cover 38 is depressed slightly. Stating this in a different way the narrow marginal portion of the cover outside the lines 40 is embossed upwardly and the marginally embossed portion is identified by the reference numeral 41. A more complete explanation of the manner in which this enhances the formation of a seal will appear hereinafter.

PRINCIPAL COMPONENT RELATIONSHIPS

Referring again to FIG. 1 the reference numeral 50 designates a table which supports all of the functional components of the carton closing and sealing apparatus. The filled cartons are brought from the filling apparatus 30 to the table 50 by a conveyor chain 52 which carries a plurality of carton carriers designated generally by the reference numeral 54. Upon emerging from the filling apparatus 30 the filled cartons first encounter and are processed by a sealing tab crimping or preforming apparatus designated generally by the reference numeral 56 which bends the sealing tabs 32 of the carton 31 downwardly and inwardly along their scoring lines 34 as will be more fully described hereinafter.

The sprocket chain 52 next engages and travels around a sprocket 58 which drives, in a manner to be described hereinafter, a carousel generally designated by the reference numeral 60 which supports at its periphery a plurality of carton closing and sealing assemblies designated generally by the reference numeral 62. From the sprocket 58 the chain 52 passes to and around a sprocket 64 which is motor driven and drives the chain 52 and through it the carousel 60. After leaving the driving sprocket 64 the chain 52 passes around idler sprockets 66, 68, 70 and 71 and from the idler 71 the sprocket chain 52, which is common to the carton filling apparatus 30 and the carton closing and sealing apparatus on the table 50, returns to the carton filling apparatus 30, the carton carriers 54 receiving, before entering the carton filling apparatus 30 empty cartons from a source and in a manner which, as previously stated, forms no part of the present invention.

On its underside the table 50 supports, as by means of bolts 299 (FIG. 14) a pair of arms 72 extending outwardly from beneath the table and the arms 72 support a burner designated generally by the reference numeral 74 which is provided with a nozzle, designated generally by the reference numeral 76, directed toward the carousel 60 for the purpose of melting the polyethylene coating on the outer surfaces of the sealing tabs 32 of the carton 31 and on the underside of the cover 38 of the carton 31, preparatory to the clamping down of the cover 38 on the open end of the carton 31 for sealing, in fluid tight condition, the top of the carton. The table also supports, by means of posts 78 a cooling duct 80 which is configured to an arc of a circle coaxial with the carousel 60, and the carton closing assembly 62 carries the cartons, which have had their cover clamped down upon its upper end, through the cooling duct 80 while air is forced into the cooling duct for cooling the heated upper ends of the cartons and also the carton closing and sealing assembly 62.

Figure 3:
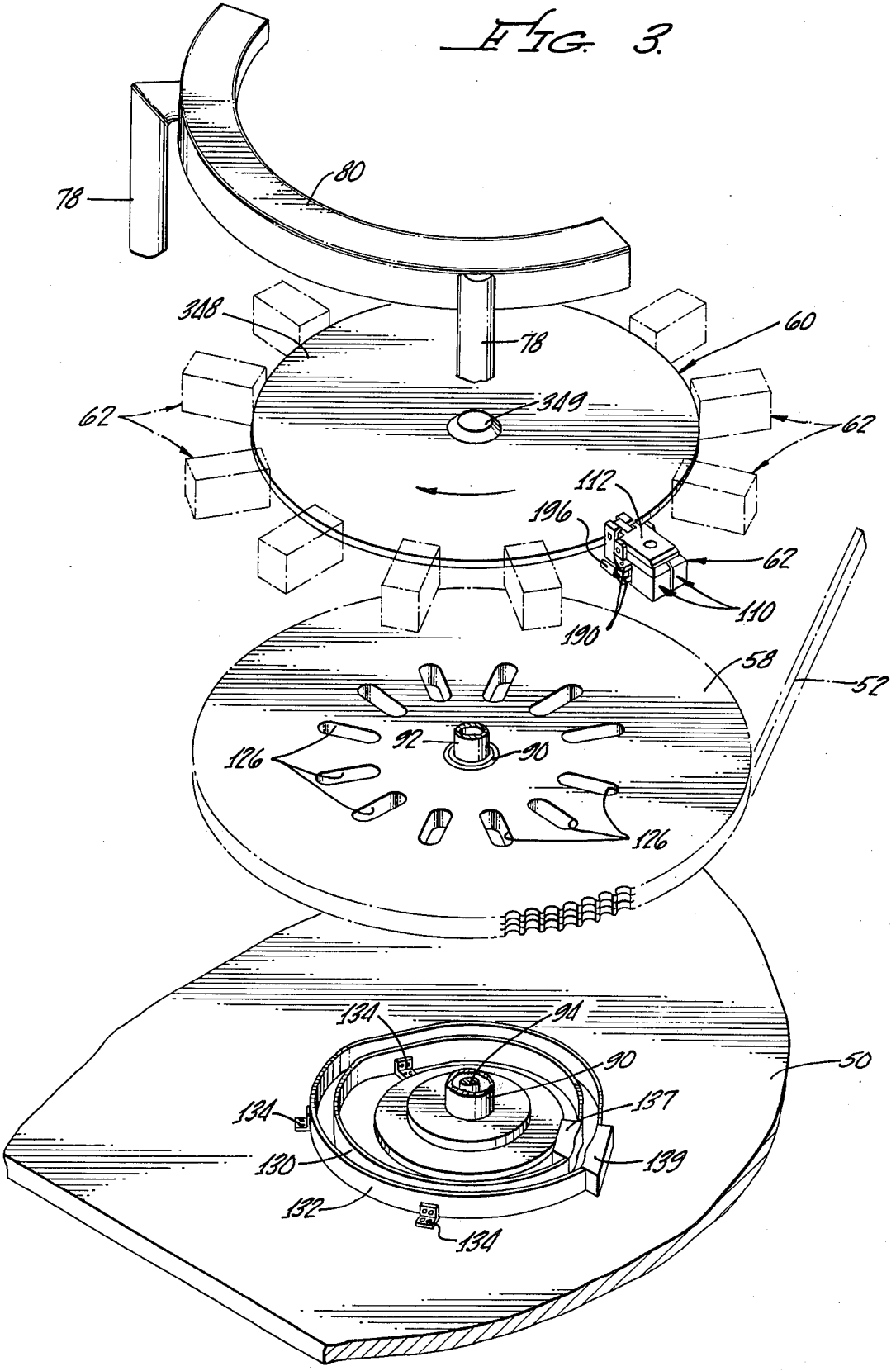
FIG. 3 is an exploded perspective view showing the principal components of the carton closing and sealing apparatus in accordance with the present invention.

Referring now to FIG. 3 it will be noted that two nested shafts 90, and 92 and a rod 94 rise from the upper surface of table 50. The two shafts and the rod are supported below the table, and the specific arrangement for supporting them and operatively associating them with one another will be described hereinafter. The outermost shaft 90 which is hollow mounts the sprocket 58 which, as previously set forth, is driven by the sprocket chain 52 from the driving sprocket 64. The hollow shaft 90 is connected to the inner hollow shaft 92 below the table to drive the latter shaft. The connection is such as to permit the inner shaft to move vertically within and relative to the hollow shaft 90. The inner hollow shaft 92 is connected to the carousel 60 that carries the carton closing and sealing assemblies 62 and drives the carousel. The rod 94 is driven by the outer shaft 90 along with the shaft 92 and it supports the inner shaft 92 and through that shaft it supports the carousel 60 for adjustment vertically.

THE CAROUSEL

Figure 5:
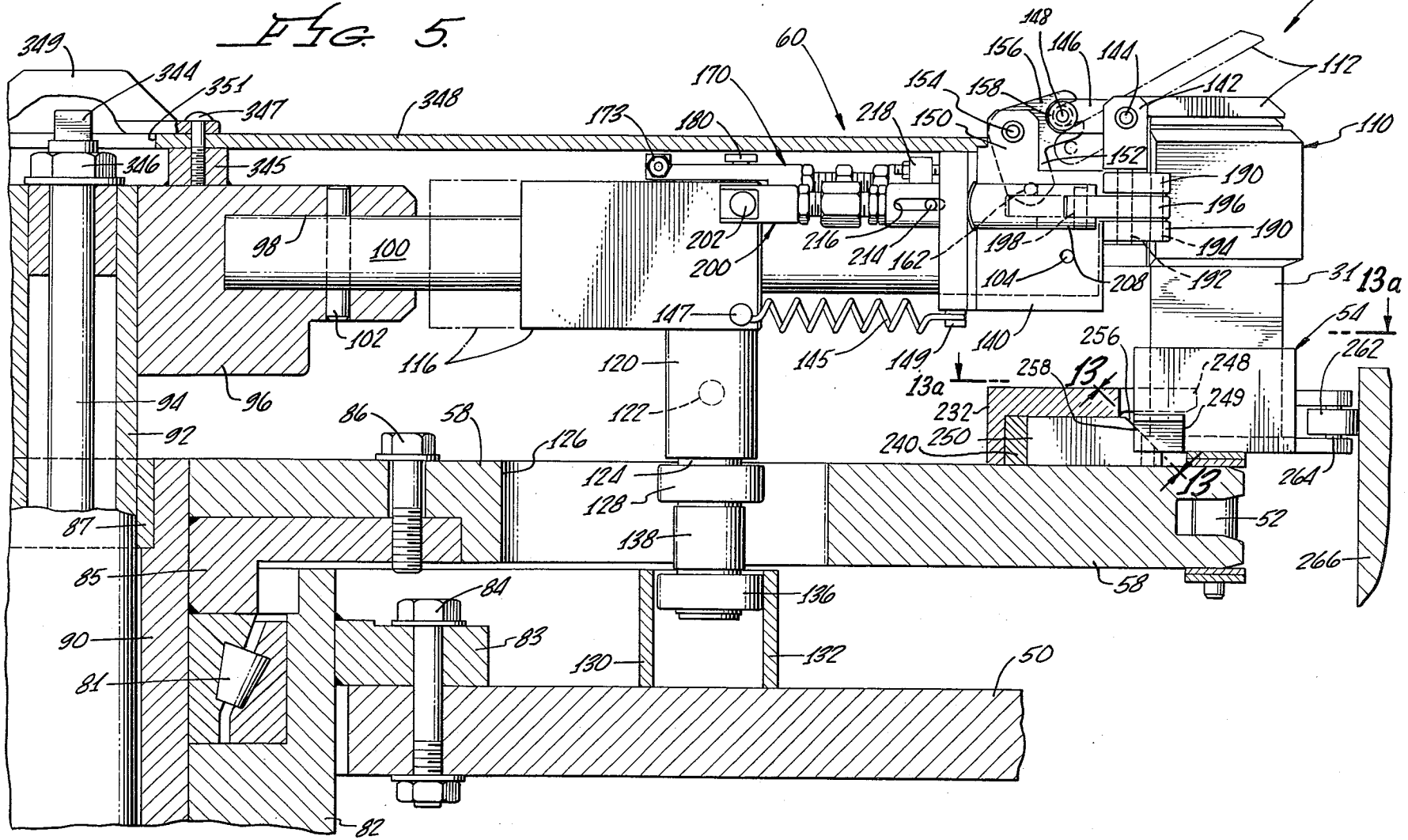
FIG. 5 is a vertical sectional view taken generally on the line 5—5 of FIG. 4.

Referring now to FIG. 5 it will be noted that the outermost component of the supporting structure for the carousel 60 is a shaft support housing 82 having secured thereto a flange 83 which is bolted to the table by a plurality of bolts 84, one of which is shown in FIG. 5. The outermost shaft 90 of the two nested shafts is rotatably supported in the housing 82 by means of the anti-friction bearing assembly designated by the reference numeral 81 and has secured thereto above the upper end of the housing 82 a hub 85. The hub 85 supports the sprocket 58 which is bolted to the hub 85 by bolts 86, one of which is shown in FIG. 5. At its upper end the outer shaft 90 contains a bushing 87 which centers the inner hollow shaft 92 in the outer shaft 90. It will be understood that centering means for the inner hollow shaft 92 as well as additional anti-friction bearing means between the housing 82 and the shaft 90 is provided below the table, as will be described hereinafter.

As will become apparent hereinafter the operation of the carousel 60 does not involve rotational motion of the shaft 92 relative to the shaft 90. However the shaft 92 and with it the rod 94 is displaceable longitudinally relative to the outer hollow shaft 90, as will also become apparent hereinafter.

Referring now to FIG. 5 it will be seen that the inner hollow shaft 92 carries at its upper end a hub 96 which is the central and supporting component of the carousel 60. The hub 96 is provided with sockets 98 into which are fitted supporting rods 100 for the carton closing and sealing assemblies 62. The rods 100 are preferably solid and cylindrical although for weight reduction purposes they might be hollow tubes provided the walls of the tubes were of sufficient thickness to support the carton closing and sealing assemblies 62. The rods 100 extend radially from the hub 96 like the spokes of a wheel and in a preferred embodiment of the invention there are twelve such equally spaced rods 100, although the number might be lesser or greater depending upon the number of carton closing assemblies 62 that are to be mounted on the carousel 60. The rods 100 are not rotatable in the holes or sockets 98 and such rotation may be prevented by rotation resisting means such as a pin 102 passing through the hub 96 and the rod 100 vertically. The pins 102 also serve to retain the rods 100 in the sockets 98.

At its outer end the rod 100 mounts the carton closing and sealing assembly 62 so that the assembly 62 will be above and in alignment with a carton carrier 54 carried by the sprocket chain 52. It will be understood that the spacing of the carton carriers 54 along the chain 52 is the same as the arcuate spacing of the carton closing and sealing assemblies 62 around the carousel 60 and that when the chain 52 fitted with carton carriers 54 is placed in association with the sprocket 58 each of the carton carriers 54 on the portion of the chain that is fully engaged with the sprocket 58 will be positioned directly beneath and in alignment with one of the carton closing and sealing assemblies 62. In a manner similar to the anchoring of the rod 100 in nonrotative relation to the socket 98 in the hub 96 a pin 104 extending horizontally through the base of the carton closing and sealing assembly 62 and through the rod 100 may be employed to preclude either axial arc rotative movement of the closing assembly 62 relative to the rod 100.

Figure 4:
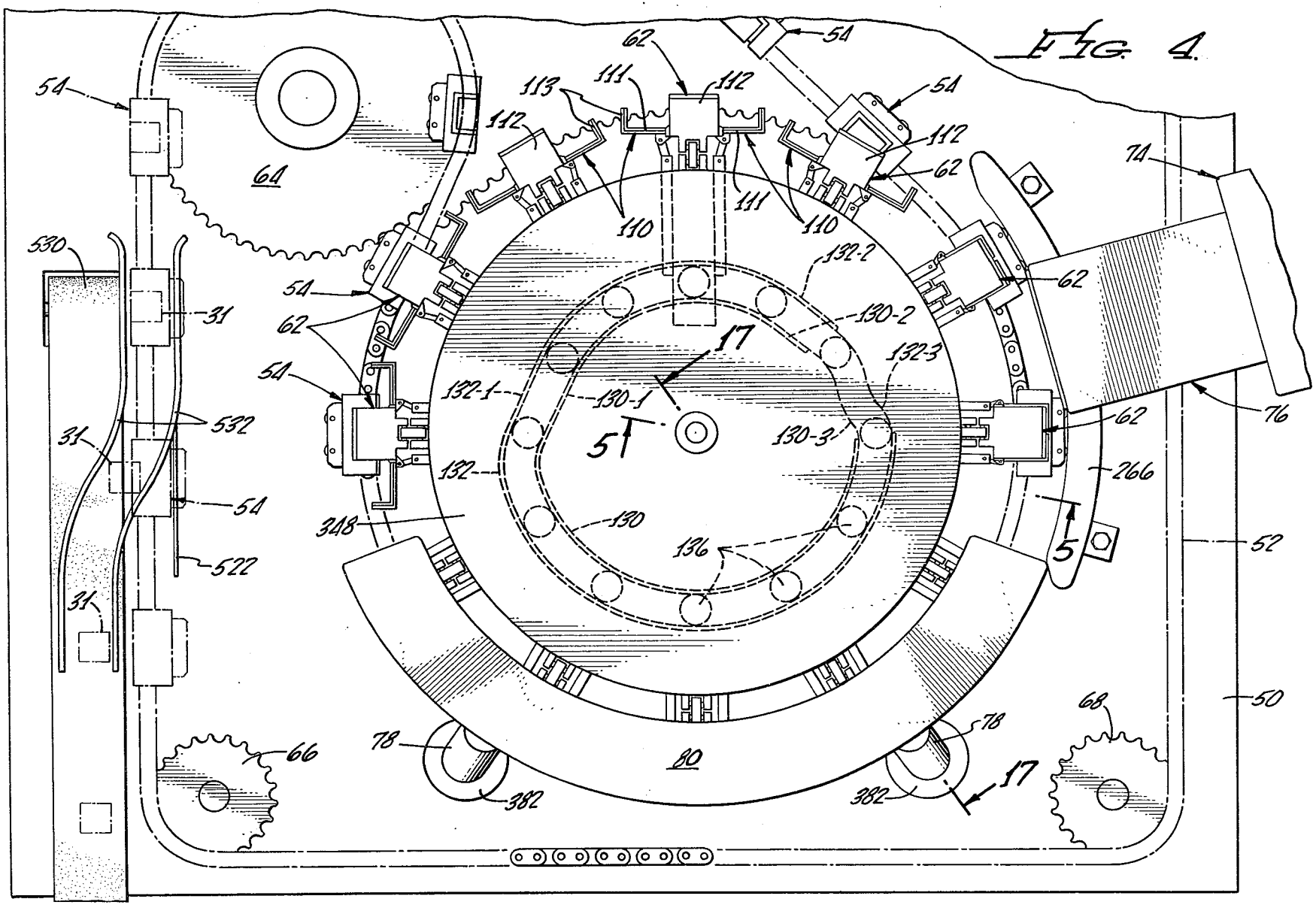
FIG. 4 is a plan view showing in greater detail most of the apparatus shown in perspective in FIG. 1.

The active or movable components of the carton closing and sealing assembly 62 are a pair of arms designated generally by the reference numeral 110 pivotally mounted on vertical axes for clasping the carton, and a carton closure panel depressing plate 112 pivotally mounted on a horizontal axis. In FIG. 4 the clasping arms 110 are shown in their fully retracted or unoperated position at the top of the figure as well as at the left and they are shown in the operated or carton clasping position at the right of FIG. 4.

The operation of the carton clasping arms 110 and the cover depressing plate 112 from unoperated to operated position is accomplished by a slide block 116 (FIGS. 5 to 9 and 12) which is mounted on the rod 100 to slide radially of the carousel outwardly and inwardly on the rod. A detail concerning the mounting of the slide block 116 to slide on the rod 100 is shown only in FIG. 12. This detail is that the slide block 116 is bored oversize in relation to the diameter of the rod 100 to receive a bushing 117 retained in the slide block 116 by a retainer ring 119. The bushing is preferably of a type called a ball bushing which is an anti-friction bearing for linear motion and includes steel balls, designated 118, disposed in longitudinally extending grooves. A source of such ball bushings in Thomson Industries, Inc., Manhasset, New York. The linkages by which the slide block 116 controls the operation of the carton clasping arms 110 and the cover depressing plate 112 as well as the details of the mounting of those components will be described hereinafter. It will of course be understood that there is one of the slide blocks 116 on each of the rods 100. Each slide block 116 has depending therefrom a socket 120 in which a rod 124 is retained by any suitable means such as a pin 122. As shown in FIGS. 3 and 5 the sprocket 58 is provided with a plurality of radially directed elongate slots 126 equal in number and corresponding in angular spacing to the radially extending rods 100 carried by the carousel hub 96. The rods 124 that extend downwardly from the slide blocks 116 pass through the slots 126 in the sprocket 58 and each rod 124 is fitted with a bearing 128 dimensioned to have contact with both of the side walls of the slot 126. Below the sprocket 58 the table 50 has mounted thereon a pair of spaced rails 130 and 132 which may be secured to the table by brackets 134, shown in FIG. 3. The rails 130 and 132 together form a cam track for controlling the back and forth radial movements of the slide blocks 116 upon the rods 110. For effecting this control of the slide blocks each rod 124 has mounted at the lower end thereof a rotatable bearing member 136 spaced from the bearing member 128 by a spacer 138 and confined between the cam track rails 130 and 132. It will be apparent in FIG. 5 that the cam track rails 130 and 132 have considerably greater height, and the sprocket 58 has considerably greater thickness than is needed for engagement by the bearings 136 and 128 respectively on the rods 124. It was previously mentioned that inner hollow shaft 92, to which the carousel hub 96 is secured, is displaceable longitudinally of the shaft 90 to which the sprocket 58 is secured. This displaceability pertains to the handling of cartons having different volumetric capacities, as will be described more fully hereinafter. At this point it is explained that in FIG. 5 the carousel 60 is shown in its uppermost position. It may be lowered with the bearings 128 and 136 remaining operatively associated with the sprocket 58 and the cam track respectively.

It is to be noted at this point that since the sprocket 58 is not a driving but a driven element, driven by the sprocket chain 52 the sprocket imparts rotation to the carousel 60 not only through a direct connection between the sprocket shaft 90 and the carousel shaft 92 at their lower ends, as will be described hereinafter, but also through the interconnection between the sprocket and the carousel provided by the bearings 128 mounted on the rods 124 which depend from the slide blocks 116 and ride in the slots 126 in the sprocket 58. It will be apparent that there are as many such driving connections between the sprocket and the carousel as there are slots in the sprocket 58 and carton closing and sealing assemblies 62 on the carousel 60.

In FIG. 5 the slide block 116 is shown in its extreme outward position relative to the carousel hub 96 and the extreme inner position is shown in dotted lines. The contour of the cam track rails 130 and 132 is shown in perspective in FIG. 3 and in more precise detail dotted lines in FIG. 4. The cam track provides three different dwell positions of the cam follower bearing rollers 136 at three different radial distances from the axis of the carousel 60. Using closk face designations to identify the three dwell positions, and referring to FIG. 4, the transition from outermost to innermost dwell occurs at about the nine o'clock position as indicated by a relatively straight portion of the rails 130 and 132 and this is represented by the relatively straight portions of the rails 130-1 and 132-1 of the rails 130 and 132. This minimum radius condition of the cam track continues through the one o'clock position where, through a second relatively straight portion of the track, designated by the rail portions 130-2 and 132-2, the intermediate radial distance of the track from the axis of the carousel 60 is reached, and at the end of this transition the cam track rollers 136 reach their intermediate outward radial position, moving the slide block outwardly to its intermediate position and effecting closure of the carton clasping arms 110 about a carton and rocking of the carton cover plate 112 part of the distance toward its carton cover clamping position. This condition of the carton closing and the sealing assembly 62 has been achieved by approximately the two o'clock position in FIG. 4. This dwell ends and a relatively fast transition of the cam track, represented by the outwardly curving portions designated by the reference numerals 130-3 and 132-3, occurs at approximately the three o'clock position, to clamp the carton cover depressing plate 112 tightly down upon the sealing flaps 32 at the upper end of the carton. This is a transition to the outermost dwell and occurs just as the carton closing and sealing assembly 62 passes out of the influence of the burner nozzle 76. This is the solid line position of the cover depressing plate 112 as shown in FIG. 5 and this maximum radius dwell of the cam track remains and holds the carton cover depressing plate 112 clamped down until the carton closing and sealing assembly 62 emerges from the cooling duct 80 at about the nine o'clock position.

As shown in FIG. 5, a tension spring 145 has one end hooked over a spring post 147 mounted on one side of the slide block 116 and the other end hooked over a spring post 149 on a bracket 140 that mounts the carton closing assembly components. A companion spring 143, seen in FIG. 12, is provided oppositely at the other side of the mounting rod 100 for the slide block 116 and the bracket 140. These springs are not intended to provide any significant part of the power for closing the arms 110 and operating the cover depressing plate 112. They serve the purpose of biasing the cam track follower rollers 136 into engagement with the outer cam track rail 132.

In FIG. 3 the cam track comprising the rails 130 and 132 has been shown as comprised of flat strip stock mounted on edge and curved to conform to the two long dwells and including the straight portion for the transition from maximum to minimum radius, but there is a discontinuity in the cam track strips which is bridged and completed by the blocks 137 and 139. These may be machined to exact profiles in order to provide exactly controlled outward movements of the slide blocks 116 from innermost to intermediate positions, from intermediate to outermost position, or both. Neither the timing of the closure or opening of the carton clasping arms 110 is particularly critical but the final movement of the carton cover depressing plate into cover clamping position before the melted polyethylene has an opportunity to congeal may be critical, and the provision of machined blocks, such as the blocks 137 and 139, is a way of controlling the movement of the slide block 116 more exactly then perhaps might be accomplished by the bending of the metal strips forming the cam track rails 130 and 132. However the cam track may if desired be formed entirely of rail strips set on edge.

The component of the carton closing and sealing assembly that mounts the movable or operational elements comprising the arms 110 and the cover depressing plate 112 is the bracket 140 fitted over the end of the carousel rod 100 and secured thereto against movement either rotationally or longitudinally by the pin 104 hereinbefore identified. On each side of its outer face, the face most remote from the hub 96 of the carousel the bracket 140 is provided with a pair of spaced upright posts 142 which support a pivot 144 for pivotally supporting the carton closure panel depressing plate 112 on a horizontal axis. To the left of the pivot 144 as seen in FIG. 5 and also in FIG. 6 the carton cover depressing plate 112 has a bifurcated extension 146 in which is mounted a pin 148 bridging the bifurcation. Inwardly in a radial direction from the end of the bifurcated extension 146 of the plate 112 the bracket 140 mounts a pair of spaced pivot supports 150 between which a bell crank lever 152 (FIG. 12) is pivotally supported on pivot 154 (FIGS. 5 and 12). The outwardly extending arm 156 of the bell crank lever 152 is bifurcated at its free end and fits over the pivot pin 148 on the extension 146 of the carton cover depressing plate 112. As indicated by the reference numeral 158 in FIGS. 5 and 6 the pin 148 that extends through the bifurcation in the extension 146 of the plate 112 may support a spool bushing 158 to engage the walls of the bifurcation in the arm 156 of the bell crank lever 152.

The end of the downwardly extending arm 160 of the bell crank lever 156 is coupled by means of a pin 162 to one end of a link which is designated generally by the reference numeral 170 (FIGS. 5 and 12). At its opposite end the link 170 is bifurcated to form a clevis which is connected to an ear 172, mounted on the top of the slide block 116 by the clevis pin 173. As specifically shown in FIGS. 5, 6 and 12 the link 170 is comprised of two portions 174 and 176 interconnected by a turnbuckle structure 178 by means of which the amount of pressure applied to the cover of a carton, when the slide block 116 is in its extreme right-hand position as viewed in FIGS. 5, 6 and 12 and the carton closure panel depressing plate 112 is in its clamping position, may be adjusted.

Figure 6:
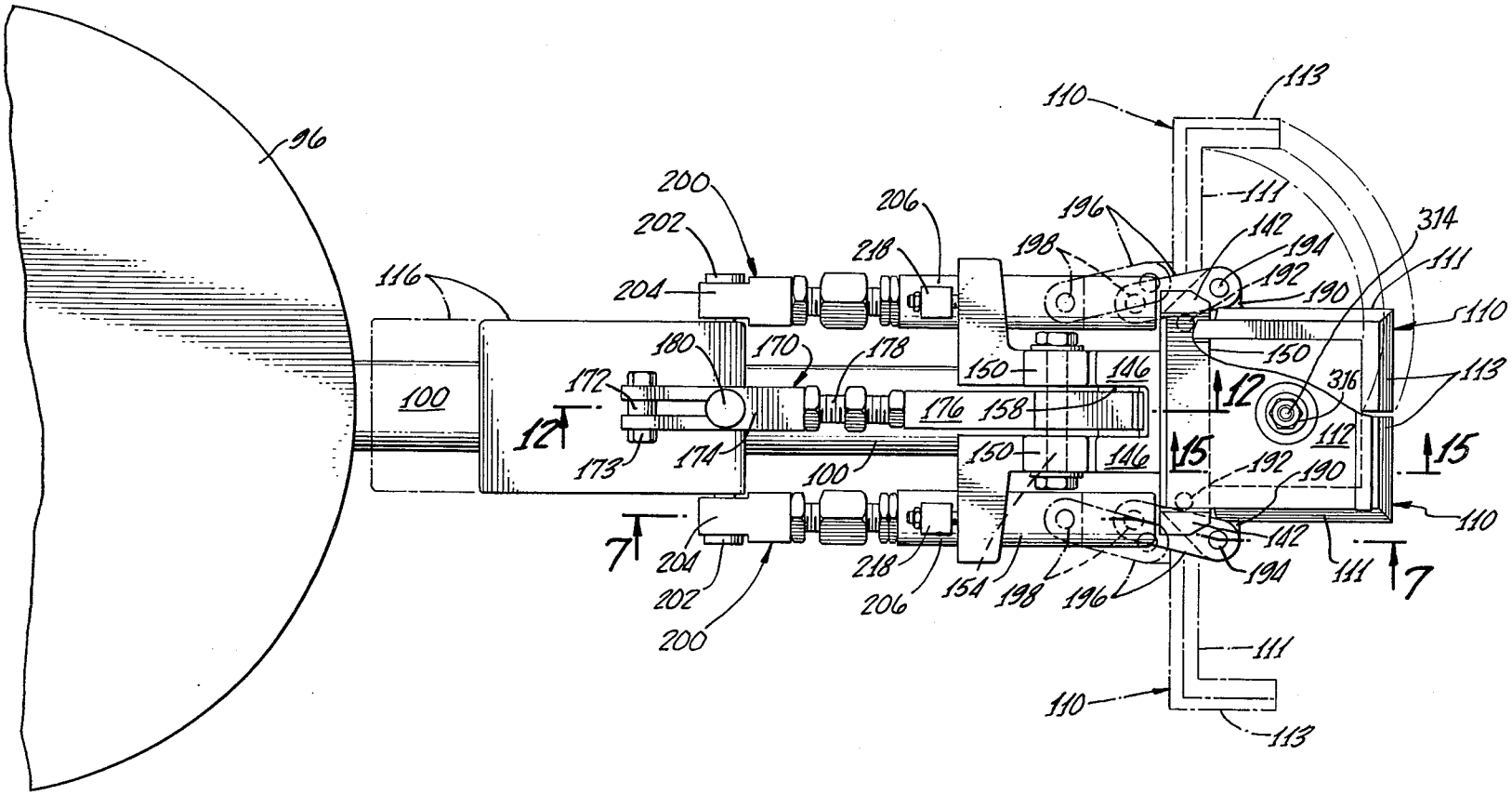
FIG. 6 is a top plan view showing in detail the carton closing and sealing assembly and operating mechanism therefore shown in elevation in FIG. 5.
Figure 7:
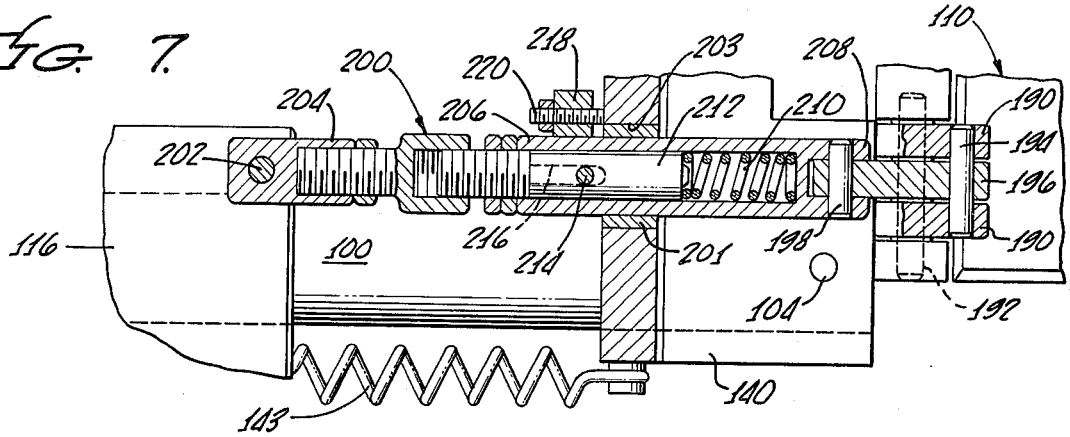
FIG. 7 is a vertical sectional view taken generally on the line 7—7 of FIG. 6 and showing as in FIG. 6 a fully operated condition of the operating mechanism.
Figure 8:
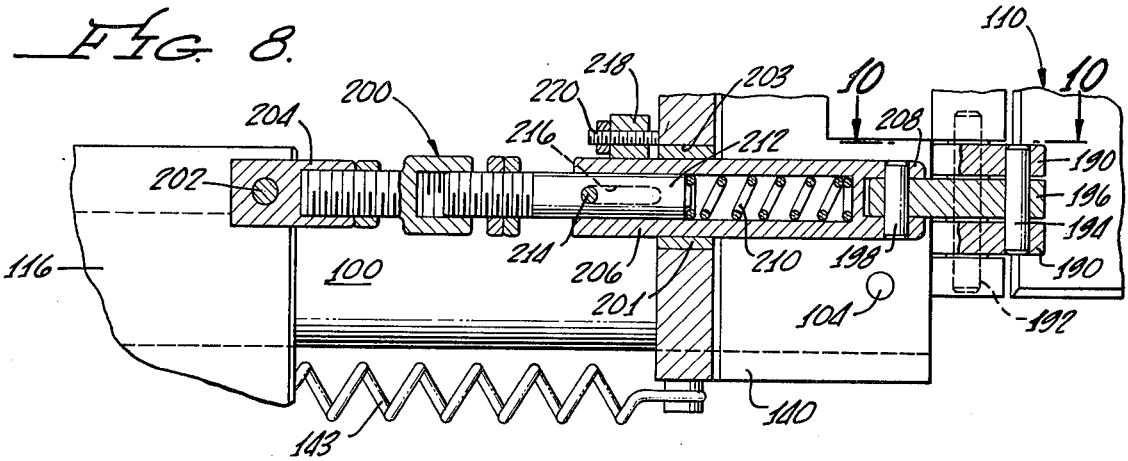
FIG. 8 is a view like FIG. 7 but showing a partially operated condition of the operating mechanism.
Figure 9:
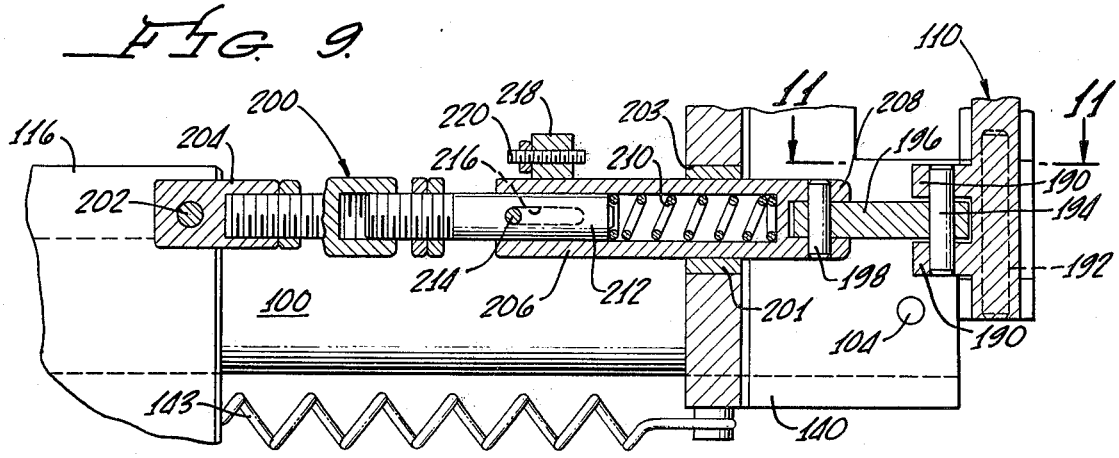
FIG. 9 is a view like FIG. 7 but showing the unoperated condition of the operating mechanism.

Since the carton closure panel depressing plate 112 is shown in its fully operated position in FIGS. 5, 6 and 12 with the slide block 116 in its extreme right-hand position the result of movement of the slide block 116 to its extreme left-hand position will be considered. As it moves leftwardly it draws the link 170 leftwardly, rocking the bell crank lever 152 clockwise. The clockwise movement of the bell crank lever 152 imparts a counterclockwise movement to the carton closure panel depressing plate through the association of the bifurcated end of the arm 156 of the lever 152 with the plate 112, and thus the plate is lifted clear of the top of a carton which has been closed and sealed. Because the pivotal connection between the link 170 and the arm 160 of the bell crank lever 152 moves in an arcuate path the link 170 undergoes a slight rocking movement about its pivotal association with the ear 172 in the slide block 116. A headed stop or limit screw 180 passes down between the arms of the clevis in the portion 174 of link 170 and threads into the slide block 116. When the slide block 116 moves rightwardly from its extreme left-hand position it rocks the carton cover depressing plate 112 clockwise.

Each of the carton clasping arms 110 is provided with a pair of spaced hinge arms 190 (FIGS. 5 to 11) which extend outwardly laterally from the sides of the arms adjacent their rear or innermost edges and which then curve inwardly behind the rear or innermost edges of those arms and are there provided with apertures to receive hinge pins. The pins are designated by the reference numeral 192 in the several figures of the drawings. As indicated in FIG. 6 the hinge pins 192 are located below and just inside the rear or inner corners of the carton closure panel depressing plate 112. The hinge pins 192 pass through hinge pin holes aligned above and below the hinge 190 in the mounting bracket 140.

In the portions of the hinge arms 190 that extend outwardly laterally from the arm 110 each is provided with an aperture to receive a pin 194 for establishing an operative connection to one end of a link 196. The other end of the link is connected by a pin 198 to the clevis-like bifurcated end of still another link, designated generally by the reference numeral 200 which is guided for endwise movement through a bushing 201 in a circular aperture 203 in the bracket 140 and is connected at its opposite end to the side of the slide block 116 by a suitable connector such as a shoulder screw 202.

To provide the same type of adjustability in the link 200 that is provided by the turnbuckle structure 178 in the link 170 the link 200 is comprised of two aligned and interconnected components 204 and 206. The right-hand portion is in the form of a sleeve terminated at its right-hand or outer end in a clevis 208 between the arms of which the link 196 is positioned and is pivotally retained therein by the clevis pin 198. The sleeve contains a compression spring 210 that is confined therein by the closed right-hand end of the sleeve and a plunger 212 engages the opposite end of the spring. A pin 214 extending radially from the plunger 212 and outwardly through a slot 216 in the wall of the sleeve provides limited relative movement between the plunger 212 and the sleeve. At its left-hand end the plunger 212 is threaded and becomes part of a turnbuckle structure through which it is connected to the component 204 that is connected to the slide block 116 by the shoulder screw 202. The sleeve has secured to the external surface thereof a projection 218 that is threaded to receive a motion limiting screw 220. Rightward or outward movement of the link 200 for closing the carton clasping arms 110 is limited when the free end of the screw 200 comes into engagement with the inner face of the bracket 140, and this is variably controllable by adjusting the screw 220.

As previously described, the cam track comprising the rails 130 and 132 provides three dwell positions for the slide block 116. In the portions of the track of minimum radius the slide block 116 is in the fully retracted position, its nearest position to the hub 96 of the carousel, the arms 110 are fully retracted, which is the dotted line position in FIG. 6 and the carton cover depressing plate 112 is in extreme counterclockwise position, shown dotted in FIG. 5. In the movement of the slide block 116 from its fully retracted position to its position of the intermediate radius of the cam track the arms 110 operate from their fully retracted position shown in dotted lines in FIG. 6 to the fully closed position shown in solid lines in FIG. 6 and also shown in solid lines in FIG. 5. The carton closure panel depressing plate 112 moves to the dotted line position shown in FIGS. 5 and 12. As previously stated this is the condition of the carton closing assembly 62 when it is traversing the nozzle 76 of the burner 74. Following the heating of the polyethylene coatings at the upper end of the carton the cam track moves the slide block 116 to its maximum radial position from the axis of the hub 96 and this moves the carton cover depressing plate 112 from the dotted line position shown in FIGS. 5 and 12 to the solid line position shown therein.

Turning now to consideration of the linkages which effect the closure of the arms 110 and the lowering of the plate 112 from their fully retracted conditions as the slide block takes its first step of movement in a radial direction from its retracted position, the solid linkage connection between the slide block 116 and the bell crank lever 156 moves the plate 112 to the dotted line position shown in FIGS. 5 and 12. The condition of the linkages 200 for controlling the operation of the carton clasping arms 110 as the first step in the movement of the slide block 116 occurs is that the compression spring 210 in the sleeve portion of the link 200 is in its completely unstressed or almost completely unstressed condition, but engaging the end of the plunger 212, which is fully retracted from the sleeve with the pin 214 at the left-hand end of the slot 216 as viewed in FIG. 9. In the first step of movement of the slide block 116 the plunger 212 and the sleeve move as a unit without relative movement between them, the spring 210 serving as the connection between the plunger and the sleeve to cause the sleeve to move outwardly radially of the carousel and close the arms 110 into the solid line positions shown in FIG. 6. The arrestment of the sleeve by the engagement of the limit screw 220 with the face of the bracket 140 serves to limit the movement of the sleeve and therefore serves to determine the firmness with which the arms 110 clasp the carton, or in other words determines the amount of pressure that the arms 110 apply against the sides of the carton. If the stop is reached before the slide block 116 completes its first step of movement the plunger 212 will move inwardly relative to the sleeve, compressing the spring 210, but not increasing the pressure of the carton clasping arms 110 against the sides of the carton. It will be remembered that the pin 214 is carried by the plunger 212 and would move in rightwardly in the slot 216 in the sleeve 206. When the slide block 116 is moved through its second step to its outermost radial position by the cam track to complete the lowering of the carton cover depressing plate 112 into clamping relation to the upper end of the carton the plunger 212 moves inwardly of the arrested sleeve, compressing the spring 210. This condition remains while the carton travels through the cooling duct and emerges.

After emergence of the carton from the cooling duct the transition from maximum to minimum radius of the cam track is encountered and the slide block is retracted to its innermost position relative to the hub 96 of the carousel. This relieves the pressure of the plunger 212 on the spring 210 in the sleeve and the plunger withdraws from the sleeve until the pin 214 comes into engagement with the left-hand end of the slot 216, after which the sleeve is positively withdrawn by the slide block to effect complete opening of the carton clasping arms 110.

It will be noted in the figures of the drawings which are plan views, particularly FIGS. 4 and 6, that the carton clasping arms 110 comprise the long arms 111 that are directly associated with the pivots 192 and that swing into engagement with the sides of the cartons, and the shorter projecting portions 113 that extend at right angles to the longer arms 111 to closely confine the carton in its association with the carton closing and sealing assembly 62. The dimensions of the short arm extensions 113 are preferably such that with a carton meeting dimensional specifications their extremities closely confront each other but just fail to meet. This assures that they will not prevent the side arms 111 from actual gripping contact with the sides of the cartons, taking into consideration that there may possibly be slight variations in the distance across the faces of the cartons.

In FIG. 6 the carton closure panel depressing plate 112 has been partly broken away to reveal the outer wall 151 of the carton closure assembly bracket 140. This is a backing wall for the carton, and the cross-sectional area bounded by this wall and the arms 110 when they are moved into clasping relation to a carton is substantially the same as the cross-sectional area bounded by the four walls of the carton so that those four walls will be firmly but not crushingly engaged when the carton is clasped by the arms 110. The dotted lines that appear on the portion of the carton closure panel depressing plate 112 that is not broken away delineate the hidden portion of the outer wall of the bracket 140 and the inner surfaces of the arm 110 that is hidden by the plate 112 and they, together with the solid lines delineating the inner surfaces of the exposed arm 110 in FIG. 6 represent the surfaces within which the four walls of the carton are clasped.

FIG. 6 also includes a dotted line showing of the path of travel of the inner and outer edges of the end face of one of the arms 110 and of the inside angle of the arm as the arm is swung into carton clasping position. It will be apparent the end face clears the corner of a carton that is positioned to be clasped as the arm swings into the clasping position.

Referring now to FIGS. 5, 13 and 13A the reference numeral 250 designates a locating fixture secured to the upper surface of the sprocket 58 and accurately positioned below and in alignment with each of the carton closing and sealing assemblies 62. The function of the locating fixture 250 is to assure exact positioning of the cartons beneath the carton closing and sealing assemblies. It is important that the carton be squared up relative to the carton closure panel depressing plate 112 not only in order that the closure panel shall be properly aligned as it is depressed by the plate 112 but also because the lower surface of the plate 112 is marginally undercut to match the indented portion of the cover 38 of the carton 31, defined by the lines 40, so that pressure will be applied by the closure panel depressing plate 112 inside those lines as well as marginally outside those lines.

The locating fixture 250 rests upon the surface of the sprocket 58 and is slidably confined in a groove 230 in a retainer block 232 that is secured to the upper surface of sprocket 58 by bolts 234. The inner end 236 of locating fixture 250 defines an obliquely oriented vertical plane and the retainer block 232 slidably retains in a tranversely extending slot 238 an adjustable backing member 240 for the locating fixture 250. The backing member 240 has an obliquely oriented surface 242 complementing the inner end of locating fixture 250. The adjustable positioning of the backing member 240 to determine the positioning of the locating fixture 250 radially of the sprocket 58 is controlled by an adjusting screw 244. A set screw 246 locks the locating fixture within the groove 230.

In order that friction between the chain 52 and the several sprockets that it engages shall not be excessive there may be some looseness between the chain, which in itself is flexible, and the sprockets, which might possibly result in slight misalignments between the carton carriers 54 and the carton closing and sealing assemblies 62. In order to eliminate any possibility of such misalignment, the locating fixture 250 is provided with a locating notch 252 (FIG. 13) to be entered by a locating pin 254 depending from the carton carrier 54. The entrance to the notch 252 is flared to guide the pin 254 into the notch and the fixture 250 is provided with outwardly facing sloping camming surfaces 256 to be engaged by matching undercut camming surfaces 258 on the carton carrier 54. The slopes of the two camming surfaces 256 and 258 may be 45°, and as the camming surface 258 on the carton carrier 54 slides against the camming surface 256 on the locating fixture 250 the carton carrier will be squared up relative to the carton closing assembly and lifted vertically, vertical slack between the chain 52 and the sprocket 58 accommodating such lifting until arrested by arms 248 of the retainer block 232 that overlie the ears 249 on the sides of the carton carrier, as shown in FIGS. 5, 13, 13A, 14 and 28. The carton carrier 54 may be provided at its side opposite the camming surface 258 with rollers 262 rotatably mounted on spindles 264. The rollers 262 cooperate with an arcuate rail 266 shown in plan view in FIG. 4 and in section in FIG. 5 and the rail 266 may be supported by the table 50 and may begin at the point in the travel of the carton carriers 54 where they come into registry with the carton closing and sealing assemblies 62 and preferably extend at least to the point of entry of the cartons into the cooling duct 80. The control exercised by the rollers 262 in cooperation with the rail 266 is that they thrust the carton carrier toward the axis of the carousel, assuring entry of the pin 254 completely into the locating notch 252 in the locating fixture 250 and also establishing cooperation between the camming surfaces 256 and 258 on the locating fixture 250 and the carton carrier 54 respectively.

THE ADHESIVE MELTING HEATER

The burner for melting the polyethylene coating in the areas of the carton to be sealed together has been shown fragmentarily in FIG. 4 and identified generally by the reference numeral 74. It is shown in some detail in FIG. 14. The burner is contained within a housing 270 which includes a housing 272 that houses the nozzle 274. The burner comprises a combustion chamber which is supplied with gas as the fuel through pipe 278 and with forced air under controlled pressure through a pipe 280 from a blower (not shown). The burner is provided with downwardly extending brackets 282 carried on opposite sides of the combustion chamber portion 276 of the burner and these brackets are pivotally associated by means of a pivot pin 284 with ears 286 upstanding on a frame 288. Spaced outwardly along the frame 288 from the pivotal mounting 284 the burner is adjustably supported on the frame 288 by the adjustable jack structure 290 comprising a threaded screw carrying adjusting and locking nuts. By adjusting upwardly or downwardly the jack screw support 290 the orifice of the nozzle 274 may be adjusted by a tilting movement of the burner into the desired position relative to the carton closing and sealing assemblies. The desired position of the orifice of the nozzle relative to that assembly is that the upper surfaces of the sealing flaps 32 and the inner surface of the closure panel 38 of the carton, as seen in FIG. 2, shall receive sufficient heat to melt the polyethylene coatings on those surfaces, without charring the paperboard, so that when the carton closure panel depressing plate 112 clamps the panel down on the sealing flaps as the carton closing and sealing assembly 62 moves out of range of the nozzle 274 the polyethylene on the surfaces that are brought into contact with one another shall congeal and produce a liquid-tight seal of the carton cover 38 to the carton 31.

Figure 14:
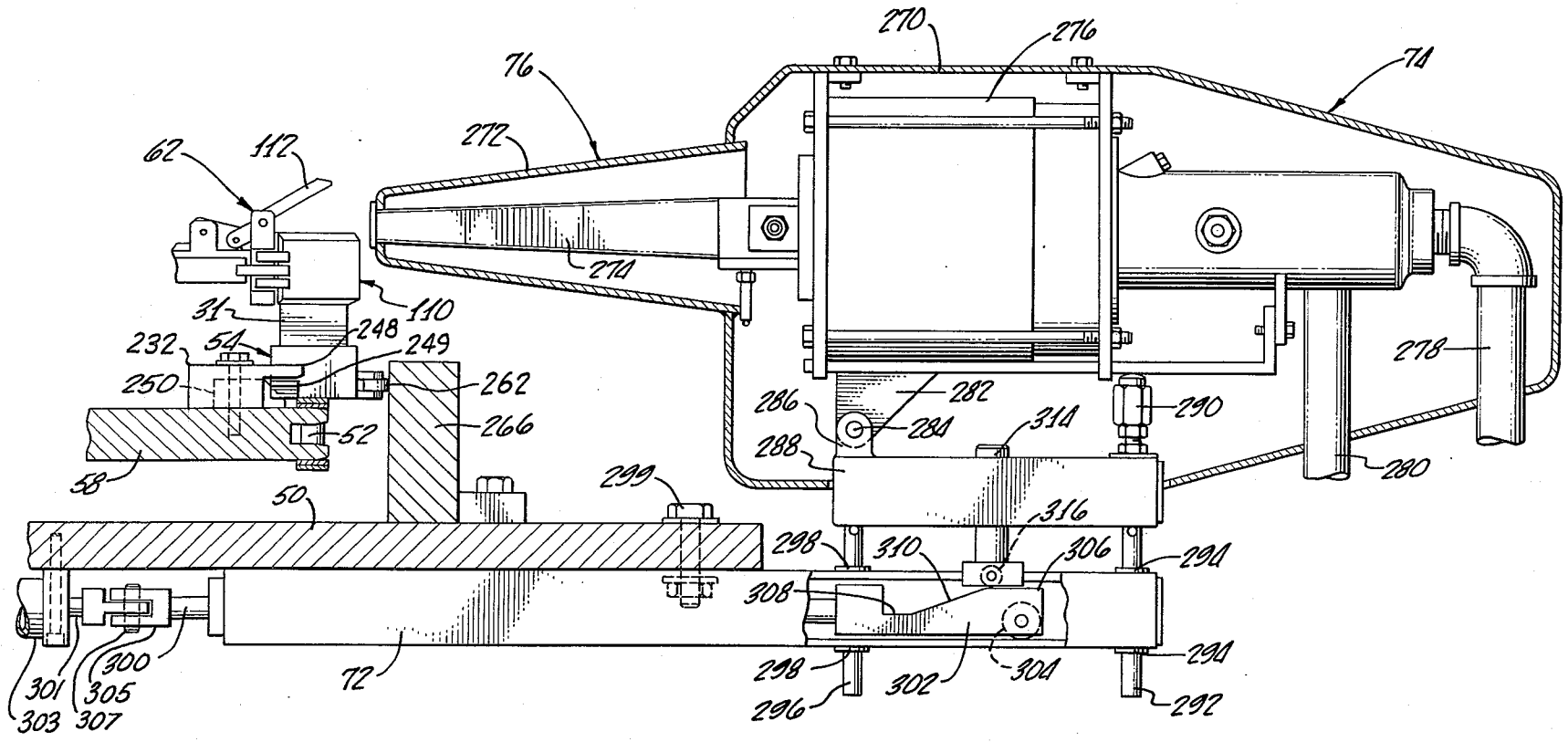
FIG. 14 is a vertical sectional view taken generally on the line 14—14 in FIG. 1.

Attention is directed to the fact that the frame 288 that supports the burner 74 is guided for vertical movement relative to the arms 72, by means of three depending rods, two of which are designated 292 and are slidably supported in bushings 294 in the arms 72, and a third rod 296 is slidable in bushing 298 in the middle of a cross member (not shown) bridging across between the arms 72. The arms 72 are attached to the underside of the table 50, as stated in the description of FIG. 1, and a bolt 299 is shown in FIG. 14 as representative of a plurality of bolts that may be employed for this purpose.

Internally the arms 72 that support the burner 74 contain and slidably support a wedge shaft 300 to which is connected, in a position beneath the burner 74, a wedge member 302. The free end of the wedge member 302 is supported on a roller 304. The wedge member 302 is provided with upper and lower dwell surfaces 306 and 308 interconnected by a sloping surface 310. About midway between the height adjusting jack screw assembly 290 and the pivot supporting ears 286 the frame 288 of the burner 74 has on each side a depending pin 314 which supports at its lower end a roller 316 that rests upon the upper surface of the wedge member 302. It will be apparent from all of the foregoing, namely the guiding of the burner support rods 292 and 296 in their respective supporting members and the supporting of the burner support frame 288 on the upper surfaces of the wedge members 302, that as the wedge rods 300 are moved rightwardly and leftwardly within the burner support arms 72 the burner will be lowered and raised by an amount which is the vertical distance between the upper and lower dwell surfaces 306 and 308 on the wedge members 302. The purpose of this adjustment is to enable the equipment to close and seal cartons having two different volumetric capacities and it will be recognized that if the carton carriers are arranged to carry a carton having one cross-sectional area, and in accordance with one embodiment of the invention this is the case, the height must vary in order to provide for the different liquid content capacities. This necessitates not only a raising and lowering of the burner to present the nozzle in the proper position relative to the cartons of the different sizes but it necessitates also a raising and lowering of the carton closing and sealing assemblies, and the invention as presented in the present disclosure provides for this, and also for a corresponding raising and lowering of the cooling duct, as will be described hereinafter.

A square carton having a cross-sectional area of four square inches and height of four inches has a liquid capacity of 16 cubic inches and this will accommodate a half pint of liquid with a little fluid capacity to spare. It should be remembered that as stated at the beginning of this specification it is contemplated that this invention shall be adapted to close and seal cartons of the type shown in U.S. Pat. No. 3,749,300. These cartons contain a readily accessible straw or sipper by means of which the liquid may be drunk directly from the carton. An expected field of use is the provision of milk for children as a part of school lunch programs, and for such potable beverages as fruit juices to be available at the refreshment stands where sporting events are held. A liquid content capacity of one-half pint is common to situations of this type. A slightly greater liquid content capacity for cartons used under these circumstances may be one-third quart, which will be accommodated with a little capacity to spare in a carton having a capacity of 20 cubic inches and this capacity may be provided by a carton two inches square and five inches tall. Thus the apparatus as disclosed herein will accommodate cartons four inches tall and five inches tall if the vertical distance between the upper and lower dwells 306 and 308 on the wedge member 302 is one inch. It may be noted that in the showing of the burner in FIG. 14 the burner is raised to its uppermost position with the roller 316 resting upon the upper dwell 306, so that the burner nozzle 274 is positioned to process the closure of the taller of two cartons and the carton closing and sealing carousel 60 is correspondingly positioned relative to the burner nozzle 274.

Figure 15:
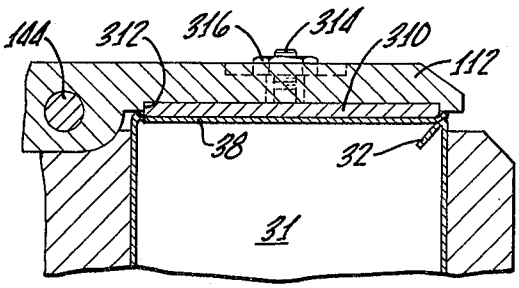
FIG. 15 is a vertical sectional view taken generally on the line 15—15 in FIG. 6.
Figure 16:
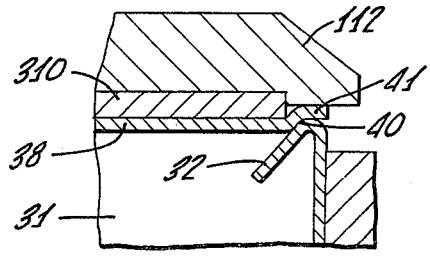
FIG. 16 is an enlarged fragmentary view of a portion of FIG. 15.

FIGS. 15 and 16 contain a detailed showing of the carton closure panel depressing plate 112 in its fully operated position, clamping the carton closure panel 38 down upon the sealing tabs 32. To match the indented area of the closure panel 38 which is surrounded by the marginally embossed portions 41, the closure panel depressing plate 112 has a central portion of its lower surface protruding relative to its marginal surface portion. As shown specifically in FIG. 15 the protrusion of that portion of the surface may be accomplished by providing an insert 310 which seats in a recess 312 in the plate 112. The insert 310 may be provided with a threaded stud 314 which passes through a hole in the plate 112 and is retained by a nut 316. It will be understood that the protruding portion of the lower surface of the plate 112 could be provided by an undercutting machining operation directly upon the lower surface of the plate 112 instead of providing a separate insert.

It will be remembered that before the plate 112 clamps the carton closure panel 38 down upon the sealing tabs 32 the carton closure assembly containing and clasping the carton 31, and with the plate 112 moved down to a position intermediate its fully retracted position and its clamping position, the upper end of the carton is carried past the burner nozzle 274, exposing the inner surface of the closure panel 38 and the upper surfaces of the sealing tabs 32 to heat in order to fuse or melt the polyethylene coatings on those components of the carton. Immediately after the carton closure assembly moves away from the burner nozzle the plate 112 is brought down into clamping position, which is the position shown in FIGS. 15 and 16. The marginal portion of the surface of the plate 112 around the protruding insert 310 presses down upon the marginally embossed portion 41 of the closure panel 38 and the protruding portion of the insert 310 presses down upon the depressed area of the carton closure panel 38 inside the embossed marginal portions 41. The result of this is, as shown particularly in FIG. 16, that the sloping portion of the closure panel 38, which comprises the transition from embossed portion 41 to the central portion of the closure panel 38, bears down upon the sealing tabs 32, bending the sealing tabs 32 obliquely downwardly and establishing a surface-to-surface interengagement between the closure panel 38 and the sealing tabs 32 in the curved transition from one to the other of the two parallel planes defined by the closure panel 38. This surface-to-surface contact in the curvature portion of the carton closure panel has been found to provide greater integrity in the seal for the retention of liquids in the carton than may be achieved with a flat or planar inner surface of a closure panel brought into flat surface contact with the sealing tabs.

CAROUSEL SUPPORTING AND POSITIONING STRUCTURE

Turning now to consideration of the support for the rotatable sprocket 58 and carousel 60 it was stated hereinbefore that the outer hollow shaft 90 to which the sprocket 58 is secured and the inner hollow shaft 92 to which the hub 96 of the carousel 60 is secured rotate together but that the inner hollow shaft 92 is displaceable longitudinally of the outer hollow shaft 90 for the purpose of raising or lowering the carousel 60 to accommodate the closing and sealing of cartons of different heights. Reference was also made previously to the provision of anti-friction bearings between the hollow shaft 90 for the sprocket and the housing 82 near the lower end of the shaft 90 beneath the table 50, and such a bearing is identified by the reference numeral 320. At its lower end the sprocket shaft 90 is threaded to receive a nut 322 which locks the sprocket shaft and its hub to the inner races of the bearings 81 and 320 and which seats those bearings against shoulders on the housing 82 thereby taking up all end play in the rotative support for the sprocket 58. The nut 322 is backed by a jam nut 324 which locks the nut 322 in place. Below the threads on the sprocket shaft 90 the shaft has diametrically opposite holes 326 to receive a bolt 328 retained by a nut 330. The inner shaft 92 which is the carousel shaft is centered within the shaft 90 at the lower end by a bushing 331 which is a counterpart of the bushing 87 at the top of the shaft 90. Below the bushing 331 the carousel shaft 92 is provided with diametrically opposite longitudinally extending elongate slots 332 through which the bolt 328 passes and which permit endwise movement of the carousel shaft 92 in the sprocket shaft 90. Rotation is imparted to the carousel shaft 92 by the sprocket shaft 90 through the transversely extending bolt 328.

At its lower end the carousel shaft 92 contains a bushing 334 into which is inserted a core or plug member 336 which is provided with an elongate slot 338 extending longitudinally of the core member 336, through which the bolt 328 passes. The core member 336 is seated on a thrust bearing 340, the lower race of which is mounted on the carousel raising and lowering structure. From the foregoing it will be apparent that the upper race of the thrust bearing 340, core 336, the carousel shaft 92 and the sprocket shaft 90 all rotate as a unit with the sprocket, the sprocket being driven by the chain 52 as previously stated.

Above the slot 338 the core member 336 is internally threaded to receive the threaded lower end of the rod 94. At its upper end the carousel shaft 92 has inserted therein and rigidly secured thereto an internally threaded sleeve 342. The upper end of the rod 94 is threaded in the opposite direction relative to the lower end and the threads in the sleeve 342 are opposite in direction of those of the core member 336. From this it will be apparent that the rod 94 and the components into which it threads, namely the sleeve 342 and the upper end of the core 336, become a turnbuckle and that by rotating the rod 94 in one direction or the other by means of its square upper end 344 the distance between the upper end of the core 336 and the hub 96 of the carousel 60 may be increased or decreased. The purpose of this is to permit accurate positioning of the carton closing assemblies 62 from the standpoint of their distance above the sprocket 58. It will be apparent that the slot 332 in the carousel shaft 92 must be of sufficient length to accommodate this adjustment of the height of the carousel in addition to the extent of the raising and lowering of the carousel for handling cartons of different heights. A locknut 346 locks the rod 94 in its relation to the threaded sleeve 342 after the desired adjustment has been made.

As shown in FIG. 5, the upper surface of the hub 96 of the carousel 60 may be provided with a number of bosses 345 (only one appearing in FIG. 5) positioned equidistantly from the axis of the carousel. The bosses are internally threaded to receive screws 347 for positioning and retaining a centrally apertured cover disc 348 for the carousel and central cover cap 349. Near its outer edge the cover disc rests on the foundation brackets 140 for carton closure assemblies 62. The central aperture 351 in the cover plate 348 affords access, after removal of the cover cap 349, to the upper end 344 of the carousel height adjusting rod 94 and to the locknut 346, which may be turned by means of socket wrenches.

Figure 18:
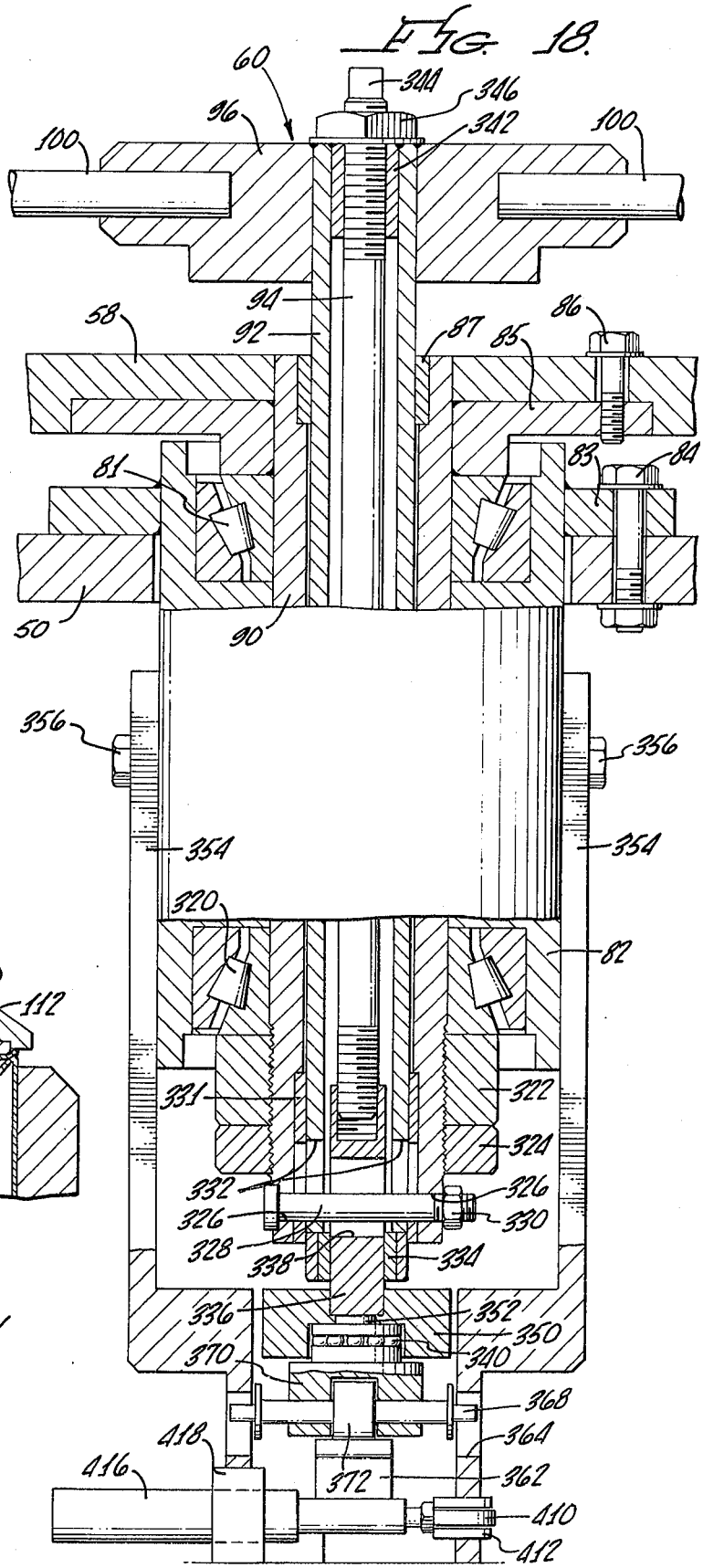
FIG. 18 is a vertical sectional view taken generally on the line 18—18 of FIG. 17.

As shown at the lower part of FIG. 18 the thrust bearing 340 is enclosed in a housing 350 which rests upon the upper or rotatable race of the thrust bearing 340. The lower end of the core 336 is reduced as indicated by the reference numeral 352 to provide a shoulder which rests upon a shoulder facing upwardly in the bearing housing 350. The reduced portion 352 of the core 336 fits into the upper race of the bearing 340. A pair of frame members 354 are attached in diametrically opposite locations to the housing 82 by means of bolts 356 and at their lower ends they support a pivot pin 360 (FIG. 17) on which is pivotally mounted a lever 362. The frame members 354 are also provided near their lower ends with vertically directed slots 364 through which extends a pin 368 which carries a roller yoke 370 upon which the lower or stationary race of the thrust bearing 340 rests and between the arms of which is mounted, on the rod 368, a roller 372. The roller in turn is supported by the rightwardly extending arm, as viewed in FIG. 17, of the lever 362 from which it becomes apparent that this lever supports, through the roller 372, the yoke 370, the thrust bearing 340, and the core 336 rotatable shaft 92 and the carousel 60 that is attached to it.

Figure 17:
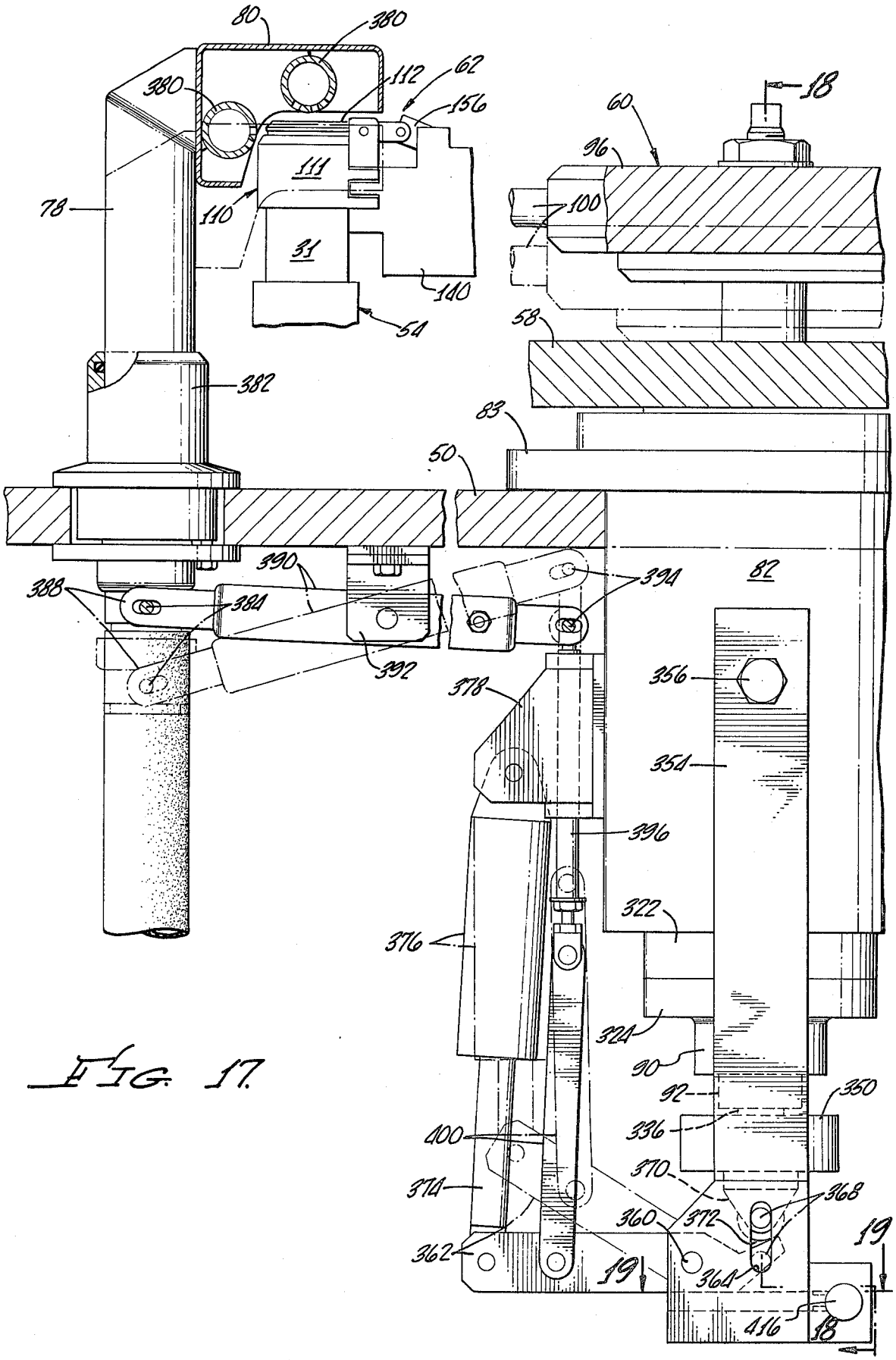
FIG. 17 is a vertical sectional view taken generally on the line 17—17 of FIG. 4.

The left-hand arm of the lever 362 is coupled at its end by means of a connecting rod 374 to the piston of an air cylinder 376 which is suspended from a bracket 378 attached to the housing 82. In FIG. 17 and also in FIG. 18 the carousel 60 is shown in its upper position for the closing and sealing of the taller of two cartons, with a dotted line showing in FIG. 17 of the carousel 60 and associated lifting and lowering components in the lower position. Thus the lever 362 is shown in its extreme counterclockwise position in solid lines in FIG. 17 and in its extreme clockwise position in dotted lines.

Referring now to FIG. 17 one of the previously identified posts 78 for supporting the coolin duct 80 is seen. The post 78 is actually a tube, as indicated by the showing of its lower end, and this tube is connected to a blower (not shown) which supplies air to perforated hollow tubes 380 in the cooling duct 80. As indicated in FIG. 4 there are two such tubular posts 78 and it will be understood that both may be connected to both of the perforated tubes 380, or each may be connected to one of them. The perforations are so located as to direct air downwardly on top of the carton closure panel depressing plate 112 and to the front edge of that plate and the upper portion of the front of the arms 110.

The table 50 has secured thereto guide sleeves 382 in which the tubular posts 78 are slidably guided. Below the table 50 and referring to the showing of a single tubular post 78 in FIG. 17 a pin 384 which extends diametrically through the tubular posts 78, or which might be separate diametrically opposite pins secured to the wall of the tubular post 78, is engaged by the slotted ends of a yoke 388 mounted on one end of a lever 390 pivotally supported by a bracket 392 secured to the underside of table 50. The other end of the lever 392 is provided with a slot in which is fitted a pin 394 of a link 396 slidable in the bracket 378 by which the air cylinder 376 is pivotally supported. The link 396 is connected by another link 400 to the left-hand arm of the air cylinder operated lever 362, as viewed in FIG. 17. From this it will be apparent that when the air cylinder 376 is activated to operate the lever 362 to its extreme counterclockwise position to effect the lifting of the carousel 60 for the closing and sealing of the taller of the two sizes of cartons that the equipment is arranged to handle, the lever 390 will be rocked clockwise through the links 400 and 396 to lift the tubular post 78 and with it the cooling duct 80. It will be understood that the other tubular post 78 is lifted at the same time through similar lever and linkage systems connecting it to the lever 362 that is operated by the air cylinder 376. The geometry of the lever system through which the lever 362 controls the tubular posts 78 is such that the cooling duct 80 is lifted the same distance as the carousel 60.

Figure 19:
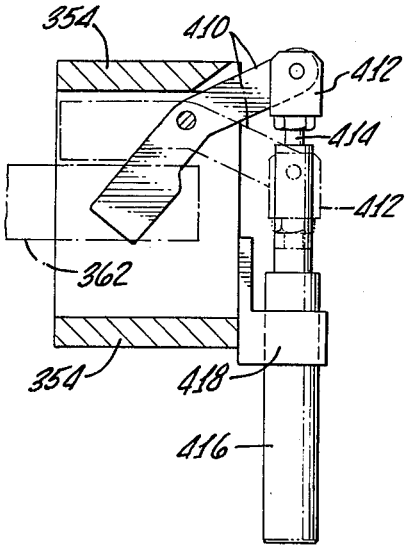
FIG. 19 is a horizontal sectional view taken generally on the line 19—19 of FIG. 17.

At the lower ends of FIGS. 17 and 18, and in greater detail in 19 is shown a safeguarding arrangement for assuring that when the carousel 60 and the cooling duct 80 have been raised they will be locked in that position. The locking instrumentality is a pivotally mounted lever which is pivotally movable in a horizontal plane between the lower, inwardly offset ends of the frame members 354, to present its left-hand end, as viewed in FIG. 19, beneath and in blocking relation to the right-hand end of lever 362, as viewed in FIG. 17, when that lever is in its extreme counterclockwise position, having been operated to that position to raise the carousel 60 to its upper position. The right-hand end of the lever 410 is engaged by a clevis 412 on the end of the piston rod 414 of an air cylinder 416 that is mounted in a bracket 418 secured to one of the frame members 354. The cylinder 416 must be activated to present the left-hand arm of the lever 410, as viewed in FIG. 19, in its solid line position as shown in that figure, after the carousel has been lifted to its upper position, and must be withdrawn by reverse activation of the air cylinder 416 to retract the lever 410 to its dotted line position as shown in FIG. 19 before the carousel 60 is lowered. The sequential valving of the air cylinders 376 and 416 for raising and locking the carousel 60 and for unlocking and lowering the carousel may be done manually or a sequencing arrangement may be employed.

In the description of FIG. 14 the method of operation of the wedge rods 300 and with them the wedge members 302 for raising and lowering the burner 76 was not described other than to make reference to the lowering of the burner along with the carousel and the cooling duct. It will be apparent that the wedge rod 300 may be connected to the piston rod 301 of an air cylinder 303 (shown fragmentally) mounted on the underside of the table 50. Any suitable means may be employed for coupling the wedge rod 300 to the piston rod 303. In FIG. 14 a clevis 305 and clevis pin 307 have been shown as the coupling components. The air cylinder for the wedge members 302 may be valved separately from or in unison with the air cylinder 376 as part of a manual sequence or it could be valved as a part of the automatic sequence. It should be noted that suitable coupling means may be provided for operating the two wedge rods 300 from one air cylinder 303.

SEALING TAB PREFORMING APPARATUS

Early in the detailed descriptive portion of this specification, and with specific reference to FIG. 1, an instrumentality for forming or flexing the sealing tabs 32 at the top of the carton 31 preparatory to closing and sealing the carton was identified generally by the reference numeral 56. The details of that instrumentality are shown in FIGS. 20 to 27 and will now be described. The top tab forming instrumentality 56 is located adjacent to the sprocket chain 52 at a point between the emergence of the chain from the carton filling unit 30 and the point at which the chain comes into contact with the sprocket 58.

Figure 20:
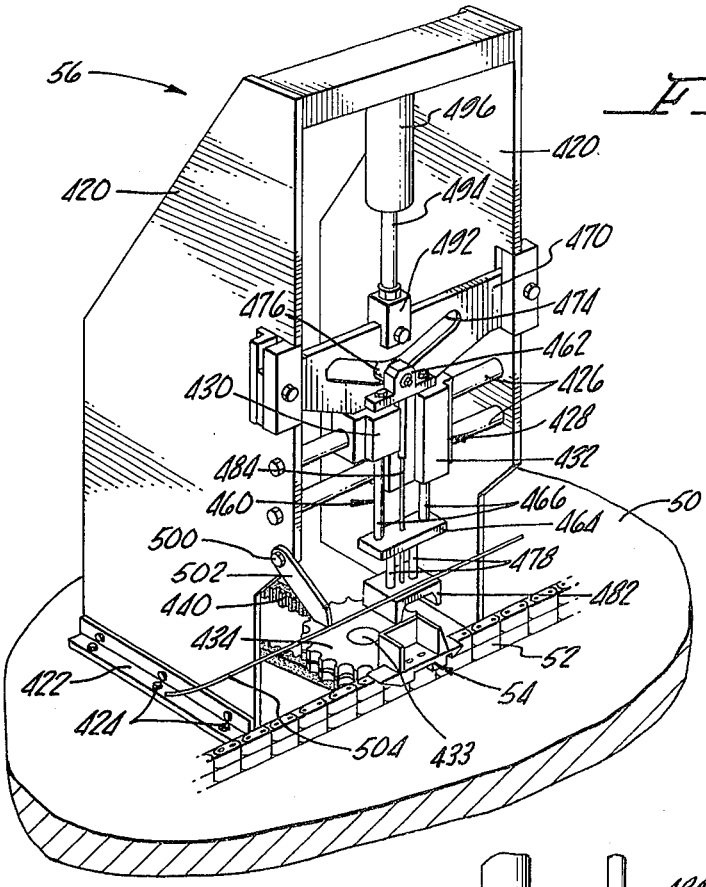
FIG. 20 is a perspective view of the apparatus shown as to location only in FIG. 1 for flexing or preforming the top sealing tabs of a carton preparatory to presentation of the carton to the closing and sealing apparatus.
Figure 25:
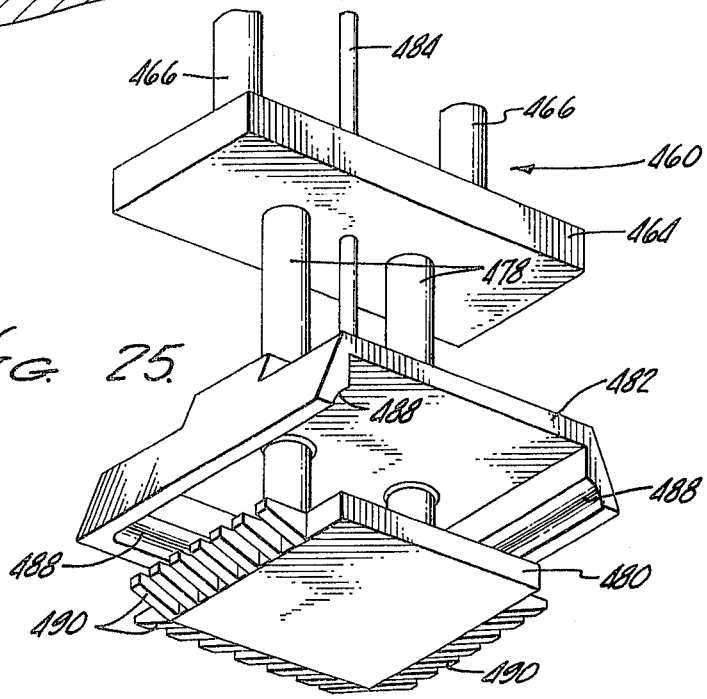
FIG. 25 is an enlarged fragmentary perspective view, viewed from below, showing principally the portions of the sealing tab preforming apparatus that come into contact with the tabs.
Figure 21:
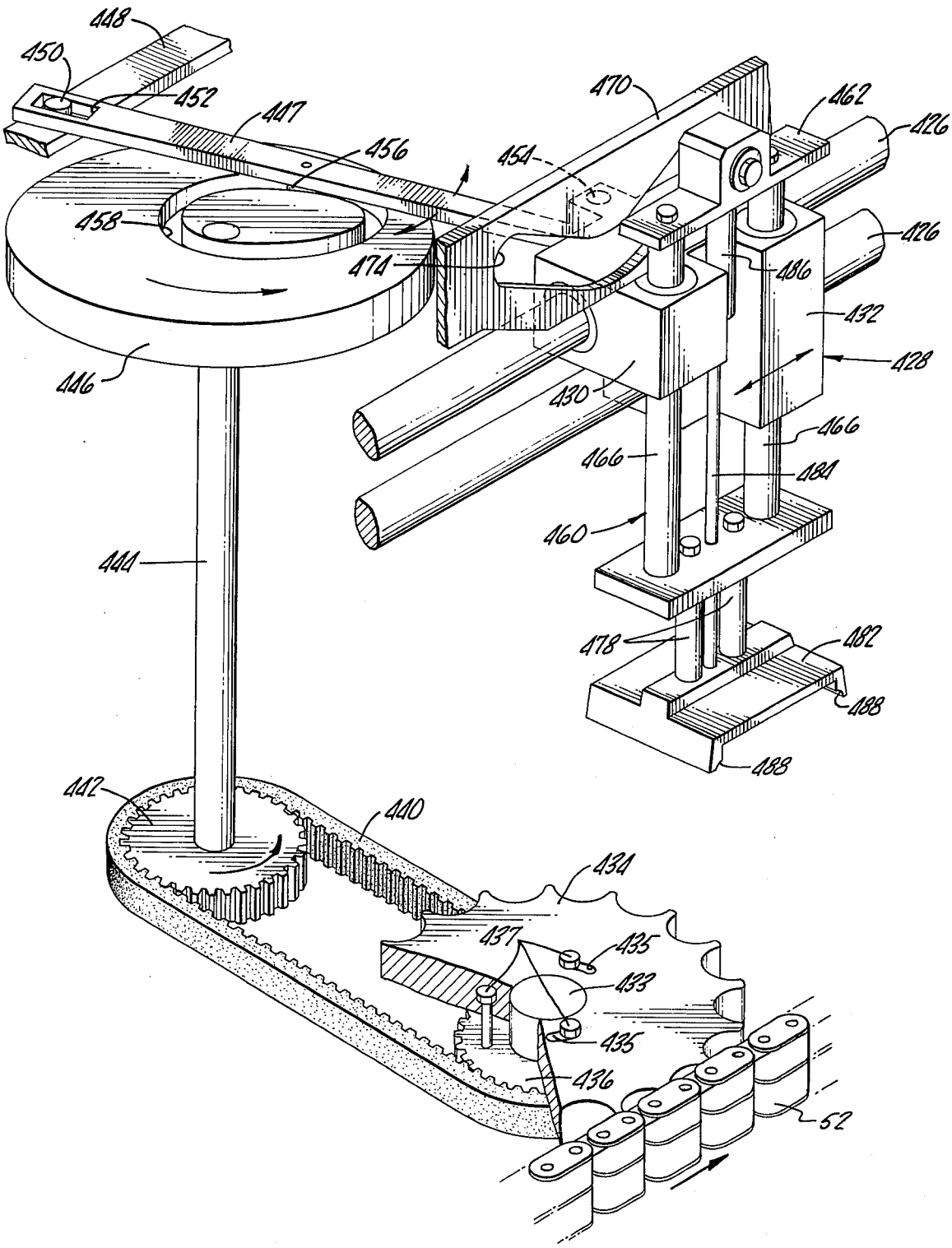
FIG. 21 is a skeletal perspective view showing the operative mechanism of the apparatus shown in FIG. 20.

As shown in FIG. 20 the top tab forming unit is supported by a pair of plates 420 that stand vertically and parallel on the table 50, secured thereto by any convenient means such as angle irons 422 and screws 424. At their forward edges and generally above the chain 52 the plates 420 support a pair of guide bars 426. These guide bars 426 slidably support a carriage designated generally by the reference numeral 428 which is comprised of left- and right-hand portions 430 and 432 which are secured together or are integral with one another, the left-hand portion 430 being slidable on the upper guide rod 426 and the right-hand portion 432 being slidable on both of the guide rods.

Between the plates 420 and table 50 rotatably supports on the shaft 433 a sprocket 434 which meshes with the chain 52. Beneath the sprocket 434 the shaft 433 carries a toothed pulley 436 (FIG. 21) that is secured to the sprocket 434 by bolts 435 which pass through arcuate slots 437 in the sprocket and thread into the toothed pulley 436. The toothed pulley 436 is connected by a toothed belt 440, sometimes called a timing belt, to a toothed pulley 442 mounted at the lower end of a shaft 444. At its upper end the shaft 444 mounts and drives a cam disc 446. The relationships of the sprocket 434 to the chain 52 and the pulley 436 to the pulley 442 are such that the cam disc 446 is driven one revolution by advancement of the chain 52 a distance equal to the distance between centers of the carton carriers carried by the chain 52.

Above the cam 446 a cam follower lever has one end pivotally connected to a frame member 448 by a pin 450 carried by the frame member 448 mounted at the rear of the tab preforming apparatus 56. The pin 450 enters a longitudinally extending slot 452 in the cam follower lever 447. At its opposite end the cam follower lever 447 is pivotally connected to the carriage member 428 by a pivot pin 454. Intermediate its ends the cam follower lever 447 carries a cam follower roller 456 which is disposed in a cam groove 458 in the cam disc 446.

The function of the cam groove 456 and cam follower lever 447 is to cause the carriage 428 to move back and forth along the guide bars 426 between the mounting plates 420. The configuration of the cam groove is such that when the carriage 428 is being moved in the same direction as the chain which is the direction from left to right as viewed in FIGS. 20 to 23, its velocity in the central portion of its total path of travel is the same as the linear velocity of the chain so that the carriage can accompany, in the central portion of its travel, a carton passing in front of the tab former 56. The contour of the cam is such as to provide a faster return from right to left so that the carriage will be returned in time to accompany the next carton passing in front of the top tab former 56.

The carriage 428 supports for movement upwardly and downwardly vertically a tab former frame designated generally by the reference numeral 460 and comprised of upper and lower cross members 462 and 464 respectively and vertical bars 466 which are preferably cylindrical. The vertical bars 466 slidably fit bores in the left and left-hand portions 430 and 432 of the carriage 428.

Figure 22:
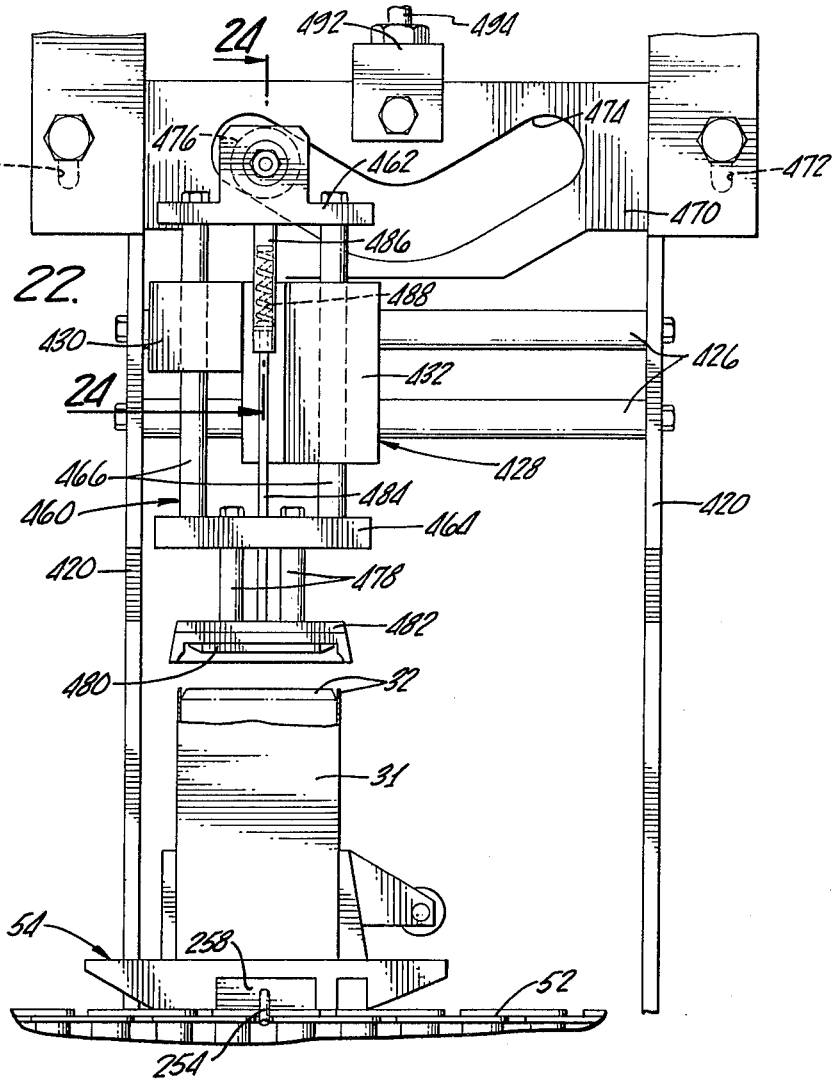
FIGS. 22 and 23 are front elevational views of the apparatus shown in FIG. 20, in successive stages of operation.
Figure 24:
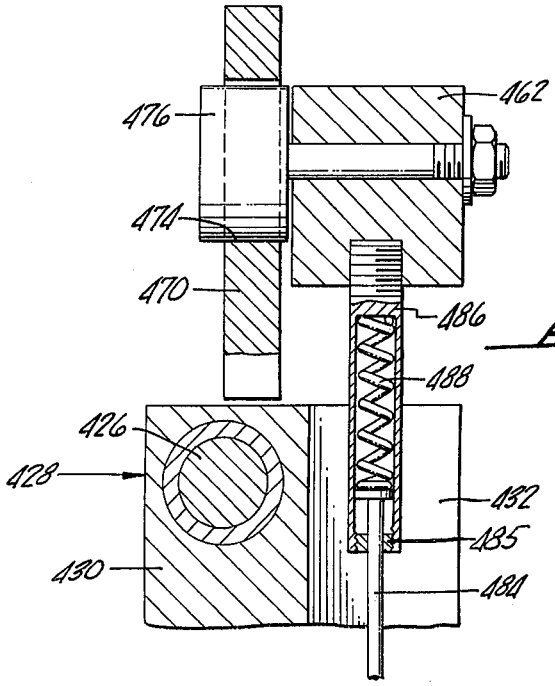
FIG. 24 is a vertical sectional view taken on the line 24—24 of FIG. 22.

Above and behind the upper cross member 462 of the frame 460 the side plates 420 support a stationary cam plate 470. The cam plate 470 has been described as being stationary because it functions in that manner but as shown in FIG. 22 it has at the ends where it is mounted on the side plates 420 vertically directed slots 472 as seen in FIG. 22. These slots provide for the raising and lowering of the cam plate 470 and this is related to the handling by the equipment of cartons of two different heights as will be described hereinafter.

The cam plate 470 is provided with a cam slot 474 which has the configuration of a shallow V centered at the center of the cam plate 470. The upper cross member 462 of the frame 460 rotatably supports a cam roller 476 which is retained in the cam slot 474. From this it will be apparent that as the carriage 428 is moved back and forth on the bars 426 by the cam disc 446 the frame 460 will be moved downwardly, the vertical rods 466 sliding in the carriage 428 until the follower roller 476 reaches the center of the slot 474 after which the frame 460 will be raised and it will repeat this lowering and raising on the return stroke of the carriage 428.

The lower cross member 464 of the frame 460 mounts a pair of depending rods 478 to the lower ends of which is secured a tab flexing or forming plate 480. Above the tab forming plate 480 the rods 478 slidably guide a preliminary tab former 482 which is secured to the lower end of a rod 484 which is slidable in the lower cross member 464 of the frame 460, and the upper end of which is slidably retained by a plug bushing 485 in a vertical bore in a rod 486 which depends from the upper cross member 462 of the frame 460. A compression spring 488 backs the upper end of the rod 484 and urges it to its lowermost position in the rod 486.

The preliminary tab former member 482 presents a downwardly facing cavity which is open on the side that faces the closure panel of the carton but that has grooves 488 around the other three sides to engage the free edges of the upstanding sealing tabs 32 of the carton and cam them inwardly along their flexure indentation or scoring lines 34 (FIG. 1). Thus the preliminary tab forming member 482 is arranged to fit over the top of a carton to a limited extent, leaving the closure panel 38 undisturbed. The tab forming member 480 has its central portion dimensioned to enter the top of the carton and on three sides it is provided with projections 490 the lower edges of which slope upwardly in a direction outwardly from the central portion of the tab former 480. They have been shown in FIG. 25 as teeth-like members although it will be understood that they could be solid.

Figure 23:
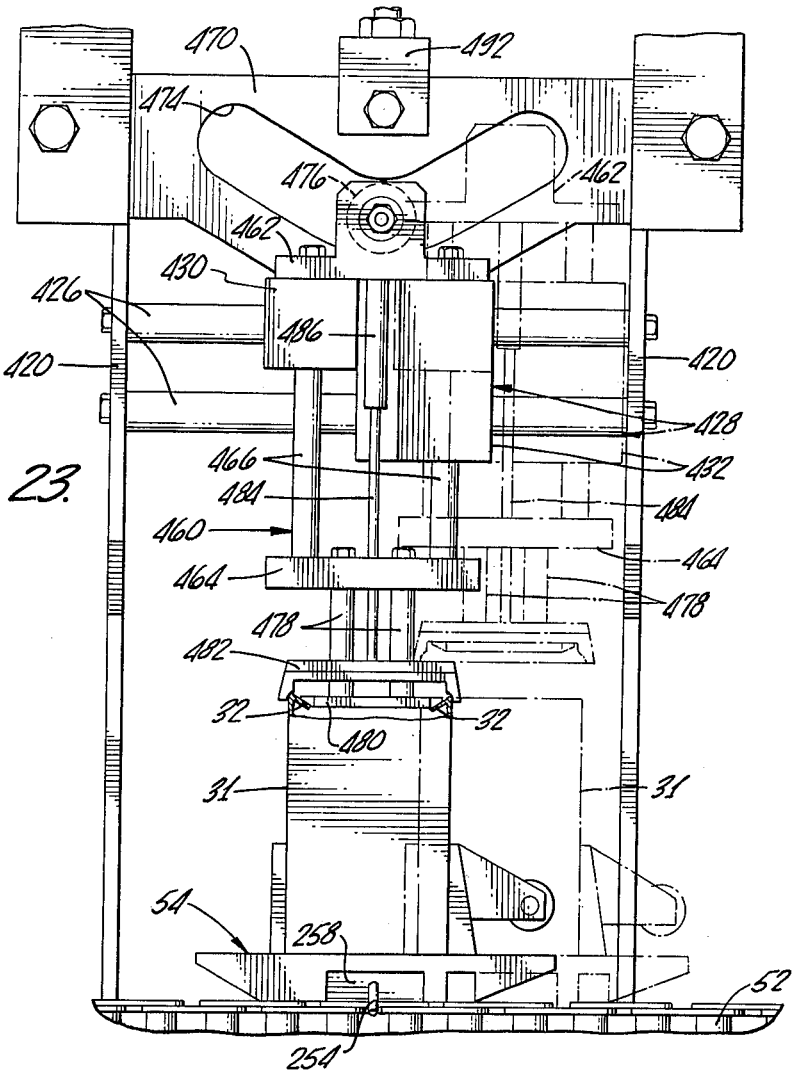
Figure 26:
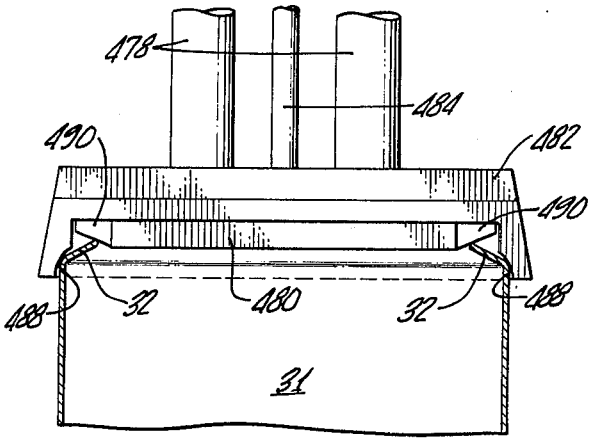
FIGS. 26 and 27 are enlarged elevational views, partly in section, showing the tab preforming components in successive steps of the tab forming operation.
Figure 27:
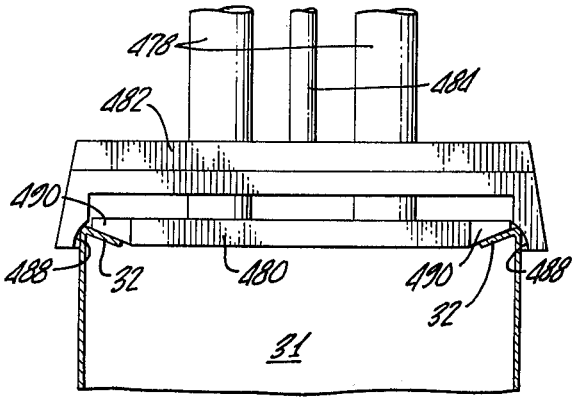

The operation of the device will now be described, reference being had particularly to FIGS. 22 and 23. FIG. 22 shows the carriage 428 travelling rightwardly from its extreme left hand position in registry with a carton 31 carried by a carton carrier 54. The cam slot 474 is driving the frame 460 downwardly which in turn is driving the plate 480 downwardly toward the carton, these connections being positive. The preliminary tab former 482 is resting upon the upper surface of the tab former plate 480, being pressed into that position by the compression spring 488. The three depending sides of the preliminary tab former 482 with the curvedly sloping surfaces 488 come into engagement with the upstanding sealing tabs 32 of the carton and bend them inwardly from their upright positions. The interior of the preliminary tab former 482 may have an area slightly less than the cross-sectional area of the carton itself so that the tab former 82 may come to rest on top of the carton having moved the tabs inwardly into the path of the tab former plate 480. The extent of flexure or forming of the tabs 321 by the preliminary tab former 482 before the plate 480 has begun its independent movement is shown in FIG. 26.

Continued positive movement of the plate 482 downwardly as the carriage 428 comes to the midpoint of its travel is under this circumstance not accompanied by further downward movement of the preliminary tab former 482, the compression spring yielding to permit the preliminary tab former 482 to remain stationary while the plate 480 continues to move downwardly. Preferably the area of the plate 480 including the projections 490 with the sloping lower surfaces is not greater than the interior cross-sectional area of the carton so that a limit position for downward movement of the plate 480 may be as shown in solid lines in FIG. 23 and in the enlarged view in FIG. 27. It will be seen that the principal tab former plate 480 bends the tabs 32 into the carton beyond a 90° angle with respect to the walls of the carton. After the frame 460 begins to rise as the carriage 428 continues its rightward movement it withdraws the tab former members 480 and 482 from association with the carton, permitting the carton to be transported onward to the carton closing and sealing apparatus. Because a paperboard coated with polyethylene tends to have a memory the tabs 32 are likely to follow the withdrawing tab formers 480 and 482 a short distance and the movement may be sufficient to bring their free edges slightly above the open end of the carton. However because they have been flexed from their original upstanding positions through an angle greater than 90° by the tab formers they will not rise much beyond an angle of 90° relative to the carton walls and the carton closure panel will have no difficulty bringing them down and sealing to their upper surfaces when the carton closure panel is pressed down in the closing and sealing operation previously described.

As the carriage 428 continues its rightward movement the tab forming components 480 and 482 are lifted clear of the carton which continues its advance toward the carton closing and sealing carousel. The next carton to have its sealing tabs pressed down by the tab former is approaching the tab former and between the completion of the forming of the tabs on one carton and the presentation of the next carton the cam groove 458 in the cam disc 446 returns the carriage from its extreme right-hand position to its extreme left-hand position. Since the cam slot 474 in the plate 470 causes the tab forming components 480 and 482 to be lowered and raised as they were in the forward stroke of the carriage 428 it will be understood first of all that the cam groove 458 in the cam disc 446 is contoured to return the carriage 428 to its left-hand position faster than its forward movement in order to enable it to begin its tab forming advance in its next cycle of operation so as to travel in unison with the next carton for the required distance. It will also be understood that the cam groove 458 will be contoured to regulate the return of the carriage 428 in such a way that no part of the tab forming components 480 and 482 will strike the departing carton which has had its sealing tabs formed, or collide with the approaching carton that is to have its sealing tabs formed.

As previously mentioned the plate 470 which contains the cam slot 474 is provided with vertically directed slots 472 at its two ends so that it may be raised and lowered for the processing of cartons of either of two different heights, in order that it will be capable of forming the top tabs on either of the two sizes of cartons that the carton closing and sealing apparatus is arranged to handle. The raising and lowering of the plate 470 will result in the raising and lowering of the frame that carries the tab forming components relative to the carriage 428 which travels only in horizontal direction. It will be understood that the length of the rods 466 that, with the cross members 462 and 464 form the frame that supports the tab forming components must be of sufficient length to accommodate the raising and lowering of the plate 470 in addition to the raising and lowering of the frame by the cam slot 474 in that plate.

It is shown in FIG. 20 that the plate 470 may be fitted at its upper edge with a clevis 492 which is connected by a connecting rod 494 to the piston of an air cylinder 496. The air cylinder 496 may be valved manually for the raising and lowering of plate 470 or it may be valved automatically in a program involving the corresponding valving of the previously identified air cylinders.

As a safeguard against interference between the top tab forming plates 480 and 482 of the top tab former 56 and the carton closure panel 38 of the carton 31 as the carton passes in front of the tab former one of the side plates 420 of the top tab former 56 may have attached thereto, as by means of a screw 500 an arm 502 extending outwardly above and toward the path of the moving carton, the arm 502 having attached thereto a deflecting guide 504 for flexing the upstanding closure panel 38 of the carton along its indentation or scoring line. The deflector 504 is curved away from the path of the closure panel of the carbon but the leading edge of that panel encounters the curved portion and rides against the deflector 504 to bend the closure panel away from the path of the tab forming plates 480 and 482. The location of the deflector 504 heightwise from the carton carrier 54 should be such that it will engage the carton closure panel somewhat below the middle of that panel for the taller of the two sizes of cartons that the apparatus is arranged to handle and a corresponding distance above the center of the closure panel for the shorter of the two cartons. With this arrangement only a single deflector 504 will be required. As previously mentioned the coated paperboard of which the cartons are made has a memory causing it to seek to return after being flexed along one of its flexure identation lines. Thus it may be expected that after the carton closure panel escapes from the deflector 504 it will tend to return to its previous upright position. In this position there is no problem involved in downward flexure of the carton closure panel by the carton closure panel depressing plate as the carton comes into association with a carton closure assembly.

Figure 28:
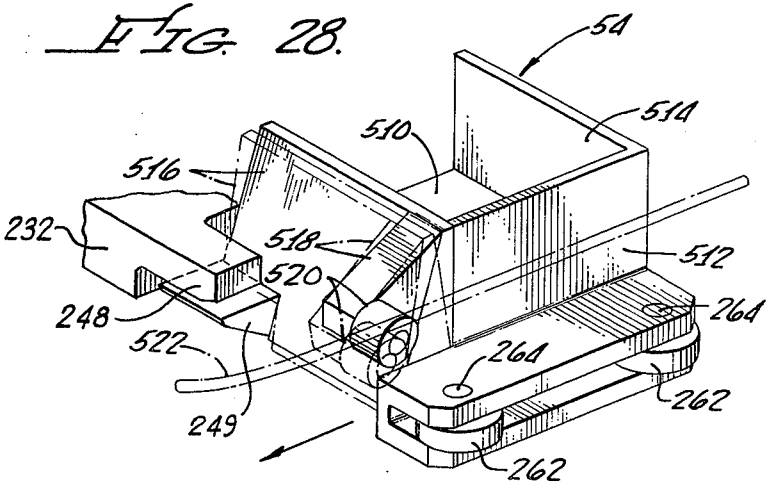
FIG. 28 is a perspective view showing a carton carrier.

The carton carrier 54 has been shown in varying degrees of completeness from phantom showings to fragmentary showings to elevational views to perspective views in various figures of the drawings, including FIGS. 1, 4, 5, 13, 14, 20, 22 and 23 for revealing in some of the figures only the fact that carton carriers are provided and for revealing specific attributes in other views. FIG. 28 is a perspective view having as its principal purpose the showing of its carton holding and retaining attributes. As seen in FIG. 28 the carton carrier 54 comprises a base 510 which rests on top of the sprocket chain, as indicated in other figures in the drawings, and which supports a back wall plate 512 and two side wall plates 514 and 516. The back wall plate 512 and the trailing side wall plate 514, the location designation of the latter having reference to the direction of travel of the carton carrier, are fixed to the base. The leading side wall plate 516 is pivotally supported on the base and is biased by means of a biasing spring (not shown) into engagement with the leading edge of the back wall plate 512. The back wall 512 is slightly longer at the bottom than at the top, from which it follows that the leading edge of the back wall 512 slants away slightly from the direction of travel of the carton carrier. When the carton carrier is empty and the leading side wall plate 516 is engaging the leading end of the back wall plate 512 the distance between the tops of the side wall plates 514 and 516 is less than the width of a carton. Thus in order for a carton to be admitted to the carton carrier 54 the pivoted side wall plate 516 must be rocked outwardly. For the accomplishment of this purpose the side wall plate 516 is provided with an outwardly extending arm 518 which carries a cam roller 520. At appropriate points in its travel the carton carrier 54 encounters a cam rail, shown schematically in FIG. 28 and designated by the reference numeral 522, which depresses the cam roller 520 to rock the side wall plate 516 outwardly to increase the distance between the tops of the side wall plates 514 and 516. As thus constructed the carton carrier 54 is a three sided receptacle for a carton. When the carrier is empty, the pivotally mounted side plate 516 must be rocked outwardly to permit a carton to be transferred into the carrier. The transfer is normally lateral through the open side of the carrier.

As stated hereinbefore empty cartons are transferred to the empty carton carriers prior to entry of the carriers into the carton filling apparatus. When the cam follower roller comes to the end of a cam rail and escapes from beneath the rail the spring biased pivotally mounted side wall plate 516 rocks into contact with the leading side wall of the carton and holds the carton squared up and in place in the carton carrier. In FIG. 28 the solid line showing of the leading side wall plate 516 is the condition of the carton carrier 54 when it is empty and the phantom showing in dotted lines represents the opening of the carton carrier to receive a carton.

The other situation for the carton carriers to encounter a cam rail is for the removal of cartons from the carton carriers after they have been filled, closed and sealed. Referring now to FIG. 4 the reference numeral 530 designates a conveyor belt to which the filled cartons are to be transferred. The belt is preferably driven at the same linear velocity as the chain 52 with its upper run supported about level with but no higher than the carton supporting surface of the carton carriers. Above the tops of the carton carrier walls the table 50 supports a pair of derail strips 532 complementarily contoured to guide the filled cartons smoothly from the carton carriers 54 onto the conveyor belt 530 by which they are carried away for packing and shipping. FIG. 4 includes a showing of a cam rail 522 encountered by the carton carriers to release the filled cartons from the grip of the pivotally mounted side wall plate 516 before the derail strips 532 begin to transfer the filled cartons from the carton carriers 54 to the conveyor belt 530.

What is claimed is:

1. Apparatus for effecting liquidtight closure of an open end of a liquid-filled carton having at said open end a single closure panel integral with the body of the carton and adapted to be brought into a closure position relative to the body of the carton and also having at said open end a plurality of narrow sealing tabs integral with the body of the carton and directed inwardly thereof for surface contact with the inside surface of said closure panel, said apparatus comprising:

platform means for supporting said carton in an upright position;

means for preparatorily conditioning the inner surface of the closure panel and the outer surfaces of the sealing tabs for adhesive interengagement;

means engageable with the outer surface of the single carton closure panel for closing it into pressure contact with the narrow sealing tabs to effect liquidtight surface interengagement between the carton closure panel and the narrow sealing tabs; and means having smooth flat carton-wall matching surfaces for completely engaging the carton walls and non-deformably clasping the carton in substantially complete contacting and gripping encompassment immediately below the top of the carton to reinforce and impart rigidity to the walls of the liquid-filled carton during the application of said pressure contact by the closure panel closing means and preclude crushing of the carton walls.

2. Apparatus in accordance with claim 1 wherein said carton clasping means comprises:

a pair of arms;

means for pivotally mounting the arms and providing complementarily with the arms for substantially complete contacting and gripping encompassment of said portion of the carton; and means for moving the pivotally mounted arms into complete contacting and crush-resistant gripping encompassment of said portion of the carton.

3. Apparatus for effecting liquid-tight closure of an open end of a carton having at said open end a closure panel integral with the body of the carton and adapted to be brought into a closure position relative to the body of the carton and also having at said open end a plurality of sealing tabs integral with the body of the carton and directed inwardly thereof for surface contact with the inside surface of said closure panel, said apparatus comprising:

platform means for supporting said carton in an upright position;

means for clasping the carton in substantially complete contacting encompassment over a portion of its height immediately below the top of the carton comprising a wall member disposed in a vertical plane for accommodating confrontation with and actual surface contact with one side wall of a carton supported by said platform means and a pair of arms pivotally associated with said wall member at a distance between the pivots to accommodate pivotal presentation of said arms in surface contact with the side walls of the carton that are contiguous with the first-mentioned side wall and provided with a right-angled projection at the end of each arm adapted by mutual confrontation of their free ends to substantially complete the encompassment of the carton;

means for preparatorily conditioning the inner surface of the closure panel and the outer surfaces of the sealing tabs for adhesive interengagement;

a plate pivotally mounted for pivotal angular movement downwardly into surface contact with said closure panel for rocking the closure panel into surface contact with the sealing tabs to effect liquid-tight surface interengagement between the carton cover and the sealing tabs;

overtravel means for imparting pivotal movement to the arms to close them into encompassing relation to the carton and for imparting in the arm closing portion of its travel pivotal movement to the plate a part of the distance toward surface contact of the closure panel with the sealing tabs and for completing in the overtravel portion of its travel the carton closure movement of the plate; and resiliently yieldable means interposed between the overtravel means and the arms for causing the arms to apply clasping pressure to the carton while absorbing the overtravel involved in completion of the carton closure movement of the plate.

4. Apparatus for effecting liquid-tight closure of an open end of a carton having at said open end a closure panel integral with the body of the carton and adapted to be brought into a closure position relative to the body of the carton and also having at said open end a plurality of sealing tabs integral with the body of the carton and directed inwardly thereof for surface contact with the inside surface of said closure panel, said apparatus comprising:

platform means for supporting said carton in an upright position;

means for clasping the carton in substantially complete contacting encompassment over a portion of its height immediately below the top of the carton;

means for preparatorily conditioning the inner surface of the closure panel and the outer surfaces of the sealing tabs for adhesive interengagement;

means engageable with the outer surface of the carton closure panel for closing it into surface contact with the sealing tabs to effect liquid-tight surface interengagement between the carton cover and the sealing tabs; and means for selectively establishing by relative movement between the carton supporting platform means and the carton clasping and closure panel closing means at least two discrete relative positions of the platform means and the clasping and panel closing means to accommodate cartons of like cross-sectional area but significantly different heights and corresponding significantly different volumetric capacities.

5. Apparatus for effecting liquid-tight closure of an open end of a carton having at said open end a closure panel attached to the body of the carton and adapted to be brought into a closure position relative to the body of the carton and also having at said open end a plurality of sealing flaps attached to the body of the carton and directed inwardly thereof for surface contact with the in-surface of said closure panel, said apparatus comprising:

a platform for supporting a carton in an upright position;

a carton backing member for supportively engaging a wall of the carton;

mounting means for mounting the carton backing member in a vertical plane for engaging said carton wall;

a pair of arms pivotally associated with said plate on vertical pivoting axes and dimensioned and contoured so as to be capable of clasping the carton in substantially complete contacting encompassment over a substantial portion of the length of the carton;

a downwardly movable carton closure panel closing plate supported on the carton backing member above and in registry with the opening in a carton supported on the platform;

an operating member articulately associated with said carton clasping arms and said carton closure panel closing plate, said operating member being operable incrementally from a retracted position first to move said arms to the carton clasping position and second to move the closure panel closing plate to clamp the closure panel of the carton down upon the sealing flaps; and means for moving the operating member from its retracted position through its increments of movement and returning it to its retracted position.

6. Apparatus in accordance with claim 5 wherein:

the articulate association of the operating member with the carton cover closing plate is direct and causes movement of the cover closing plate through a part of its distance toward the closure panel clamping position in its first increment of movement and to complete the clamping in its second increment of movement.

7. Apparatus in accordance with claim 5 wherein:

the articulate association of the operating member with the carton clasping arms includes resiliently yieldable means for absorbing the overtravel of the operating member attendant upon the operation of the closure panel closing means into its cover clamping position in the second increment of movement of operating member.

8. Apparatus in accordance with claim 5 including:

means for varying the vertical distance between the carton supporting platform and the operational paths of travel of the carton clasping arms and the closure panel closing plate to accommodate cartons of like cross-sectional area but different volumetric capacities.

9. Apparatus in accordance with claim 5 including cam means for moving said operating member from its retracted position through each of its incremental movements and for restoring it to its retracted position.

10. Apparatus for closing and sealing a filled carton formed of paperboard coated with a liquid-impermeable material that is conditionable to exhibit adhesive properties, said carton having an open end provided with narrow sealing tabs directable inwardly of said carton end and provided also with a single closure panel integral with the carton and depressible into surface-to-surface contact with the narrow sealing tabs, said apparatus consisting essentially of:

a platform for supporting the carton in an upright position;

means for conditioning the coating on the upper surfaces of the sealing tabs and the lower surface of the closure panel to exhibit its sealing property;

means for depressing the closure panel into surface contact with the sealing tabs with sufficient contact pressure to effect liquid-tight sealing of the single closure panel to the narrow sealing tabs using the adhesively conditioned coating as the sealing agent; and means having smooth flat carton-wall matching surfaces for completely engaging the carton walls and non-deformably clasping the carton in substantially complete contacting and gripping encompassment immediately below the top of the carton to reinforce and impart rigidity to the walls of the liquid-filled carton during the application of said pressure contact by the closure panel closing means and preclude crushing of the carton walls.

11. Apparatus in accordance with claim 10 wherein:

the coating on the paperboard of which the carton is formed is polyethylene; and the means for conditioning the coating to exhibit adhesive properties is a source of heat.

12. Apparatus for effecting liquid-tight closure of an open end of a liquid-filled carton having at said open end a closure panel integral with the body of the carton and adapted to be brought into a closure position relative to the body of the carton and also having at said open end a plurality of sealing tabs integral with the body of the carton and directed inwardly thereof for surface contact with the inside surface of said closure panel, said apparatus comprising:

a conveyor;

means for driving the conveyor;

a plurality of carton carriers comprising carton supporting platforms and carton gripping and retaining means carried by said conveyor in uniform spacing relative thereto;

a rotatably mounted disc peripherally engaged by said conveyor over a substantial portion of its periphery;

a rotatable carousel mounted coaxially with respect to the disc;

a driving connection between the disc and the carousel;

a plurality carton closure assemblies carried by the carousel at radial distance from the axis of the carousel and arcuate spacing of the assemblies from one another to accommodate vertical registry of the assemblies with the carton carriers as the carriers are transported around the rotatably mounted disc by the conveyor;

said carton closure assemblies comprising:

a member carrying a vertically disposed flat plate adapted to back and supportively engage a wall of a carton presented by a carton carrier;

a pair of arms movably mounted on said member and dimensioned and contoured so as to be capable of clasping the carton is substantially complete contacting encompassment over a substantial portion of the length of the carton and movable into carton clasping positions;

a carton closure panel closing plate movably mounted on said memfber and operable to depressively rock the closure panel into surface contact with the sealing tabs at the top of the carton;

means for operating said carton clasping arms; and means for operating said closure panel closing plate.

13. Apparatus in accordance with claim 12 wherein:

the conveyor is an endless sprocket chain; and the rotatably mounted disc is provided on its periphery with sprocket teeth conformed to match and be engaged by the sprocket chain.

14. Apparatus in accordance with claim 12 wherein the means for operating the carton clasping arms includes for each of the carton closure assemblies:

an operator supported by the carousel for movement relative to the carousel;

means for operatively connecting the operator to the movable mounted carton clasping arms of its associated carton closure assembly for effecting movement of the arms;

stationarily mounted cam means; and means for controllably associating the operators with the cam to cause clasping and unclasping motion of the arms by virtue of rotational movement of the carousel relative to the stationary cam means.

15. Apparatus in accordance with claim 12 wherein the means for operating the carton closure panel closing plate includes for each of the carton closure assemblies:

an operator supported by the carousel for movement relative to the carousel;

means for operatively connecting the operator to the movably mounted carton closure panel depressing plate of its associated carton closure assembly for effecting movement of the plate;

stationarily mounted cam means; and means for controlling associating the operators with the cam to cause lowering and raising of the plate by virtue of rotational movement of the carousel relative to the stationary cam means.

16. Apparatus in accordance with claim 12 wherein the means for operating the carton clasping arms and the carton closure panel closing plate includes for each of the carton closure assemblies:

an operator supported by the carousel for movement relative to the carousel;

means for operatively connecting the operator to the movably mounted carbon clasping arms of its associated carton closure assembly for effecting movement of the carton clasping arms of its associated carton closure assembly to clasp the carton;

means for operatively connecting the same operator to the movably mounted carton closure panel closing plate of its associated carton closure assembly for effecting carton closing movement of the plate;

stationarily mounted cam means; and means for controllably associating the operators with the cam to cause clasping and unclasping motion of the arms and lowering and raising of the plate by virtue of rotational movement of the carousel relative to the stationary cam.

17. Apparatus in accordance with claim 16 wherein: the operator is supported by the carousel for relative movement radially thereof.

18. Apparatus in accordance with claim 16 wherein: the operator is supported by the carousel for reciprocatory movement radially thereof.

19. Apparatus in accordance with claim 16 wherein the cam means includes:

a first dwell condition for establishing an unoperated position of said operator;

a second dwell condition and transition thereto from the first dwell condition for establishing a first increment of operative movement of said operator to effect full closure of said arms and an increment of movement of carton closure panel closing plate toward its fully operated position; and a third dwell condition and transition thereto from the second dwell condition for effecting a second increment of operative movement of said operator to effect full closure panel depressing operationn of said panel closing plate.

20. Apparatus in accordance with claim 19 wherein: the means for operatively connecting the operator to the carton clasping arms includes yieldable means for accommodating movement of the operator through its second increment of movement after having effected full carton clasping operation of said arms.

21. Apparatus in accordance with claim 19 wherein: the means for operatively connecting the operator to the carton clasping arm has associated therewith means for controllably limiting the amount of movement imparted to the arms and the amount of pressure applied by the arms to the carton walls.

22. Apparatus in accordance with claim 21 wherein: the means for operatively connecting the operator to the carton clasping arms comprises separate connecting means for each arm of a carton closing assembly; and the limiting means comprises separate limiting means for each connecting means and arm to accommodate equalization of movement of the arms.

23. Apparatus in accordance with claim 16 wherein: the stationary mounted cam means is supported by a table;

the rotatably mounted disc is rotatably supported by the table above the cam means;

the carousel is rotatably supported by the table above the disc;

the disc is provided with radially directed elongate slots in vertical registry with carton closure assembly operators; and the means for controllably associating the operators with the cam means pass through the slots in the disc.

24. Apparatus in accordance with claim 23 wherein: the cam means comprises a pair of rails mounted on the table and uniformly spaced apart and contoured to provide first, second and third dwell conditions and transitions from each dwell condition to the next in endless repetitive sequence; and the means for controllably associating the operators with the cam means comprises a post depending from each of the operators and passing through a slot in the disc and a cam follower roller mounted on the lower end of the rod and disposed between the rails of the cam means.

25. Apparatus in accordance with claim 23 wherein: the portions of the contours of said cam means representing critical timing in the operation of the cam follower are formed by precisely controlled machining operations and the remainder of the cam means if formed by bending strip material into specific but generally non-critical configurations.

26. Apparatus in accordance with claim 19 wherein the cartons to be closed have at least on the inner surface of the carton closure panel and on the outer surfaces of the sealing tabs a coating of heat fusible polyethylene and the apparatus includes:

a source of heat of sufficient intensity to fuse the polyethylene having a nozzle with its orifice adjacent to the path of travel of the upper ends of the cartons and generally coextensive angularly with the second dwell condition of the cam.

27. Apparatus in accordance with claim 19 which includes:

a cooling duct generally coextensive angularly with the third dwell condition of the cam and positioned to be traversed by the carton closure assemblies after traversal of the nozzle of the heat source; and means for forcing cool air into said duct for cooling the heated carton closure assemblies and the cartons clasped and clamped by those assemblies.

28. Apparatus in accordance with claim 27 which includes:

means for varying the vertical spacing of said carousel, said heat source nozzle and said cooling duct relative to said carton carries to accommodate cartons of like cross-sectional area but different volumetric capacities.

29. Apparatus in accordance with claim 12 wherein said carousel comprises:

a shaft coaxial with and drivably connected to said rotatably mounted disc;

a hub member secured to said shaft; and a plurality of rods secured to said hub member in equal angular distribution thereabout and extending radially outwardly therefrom and having secured to their outer ends the carton closure assemblies and slidably mounting the operators for the carton closure assemblies between those assemblies and the hub.

30. Apparatus in accordance with claim 12 wherein:

a plurality of carton carrier positioning fixtures are secured to the upper surface of the rotatably mounted disc adjacent to the periphery, each being in registry vertically below one of the carton closure assemblies and each provided with an outwardly facing locating notch and an outwardly facing sloping camming surface;

each of said carton carriers having a locating member for entry into the locating notch in the positioning fixture and a sloping camming surface complementing the camming surface on the positioning fixture and cooperable with the camming surface on the locating fixture for constraining said carton carrier to dispose its carton supporting platform in a horizontal plane; and including means comprising at least two rollers carried by each of said carton carriers on vertical axes and a stationarily mounted rail engageable by said rollers for aiding the conveyor in establishing cooperative interengagement of the sloping camming surfaces on the locating fixture and on the carton carrier.

31. Apparatus in acccordance with claim 30 wherein:

said stationarily mounted rail has its carton carrier controlling surface on an arc that is coaxial with the rototable disc and begins generally just prior to operation of the arms to their carton clasping position and ends prior to retraction of the arms and the closure panel depressing plate to their unoperated conditions.

32. Apparatus for effecting liquid-tight closure of an open end of a liquid-filled carton having a said open end a single closure panel integral with the body of the carton and adapted to be brought into a closure position relative to the body of the carton and also having at said open end a plurality of narrow sealing tabs integral with the body of the carton and directed inwardly thereof for surface contact with the inside surface of said closure panel, said apparatus comprising:

platform means for supporting said carton in an upright position;

means associated with said platform means for engaging said carton and assuring retentive association of the carton with the platform;

means for preparatorily conditioning the inner surface of the closure panel and the outer surfaces of the sealing tabs for adhesive interengagement;

means engageable with the outer surface of the single carton closure panel for closing it into pressure contact with the narrow sealing tabs marginally of the closure panel to effect liquid-tight surface interengagement between the carton closure panel and the sealing tabs; and means additional to and independent of said platform associated carton engaging means and having smooth flat carton-wall matching surfaces for completely engaging the carton walls and non-deformably clasping the carton in substantially complete contacting and gripping encompassment immediately below the top of the carton to reinforce and impart rigidity to the walls of the liquid-filled carton during the application of said pressure contact by the closure panel closing means and preclude crushing of the carton walls.

33. Apparatus in accordance with claim 32 wherein:

the platform-associated means for engaging the carton includes a member movable with respect to the platform for engaging the carton and means for forcing the member into engagement with the carton.

34. Apparatus in accordance with claim 32 wherein the platform-associated means for engaging the carton includes:

a barrier member carried by the platform;

a movable member carried by the platform in confronting and spaced relation to the barrier member to accommodate the entry of a carton therebetween;

and biasing means associated with the movable member for forcing the movable member to retentively confine the carton between itself and the barrier member.

35. Apparatus in accordance with claim 34 wherein the barrier member and the movable member are dimensioned to retentively engage the carton at its lower end.

36. Apparatus for effecting liquid-tight closure of an open end of a carton having at said open end a closure panel integral with the body of the carton and adapted to be brought into a closure position relative to the body of the carton and also having at said open end a plurality of sealing tabs integral with the body of the carton and directed inwardly thereof for surface contact with the inside surface of said closure panel, said apparatus comprising:

platforms means for supporting said carton in an upright position;

means for clasping the carton in substantially complete contacting encompassment over a portion of its height immediately below the top of the carton;

means for applying heat to the inner surface of the closure panel and the outer surfaces of the sealing tabs to condition them for adhesive interengagement;

means engageable with the outer surface of the carton closure panel for closing it into surface contact with the sealing tabs to effect liquid-tight surface interengagement between the carton cover and the sealing tabs;

means for selectively establishing by relative movement between the carton supporting platform means and the carton clasping and closure panel closing means at least two discrete relative positions of the platform means and the clasping and panel closing means to accommodate cartons of like cross-sectional area but significantly different heights and corresponding significantly different volumetric capacities; and means for selectively establishing by relative movement between the carton supporting platform means and the heat applying means at least two discrete relative positions of the platform means and the heat applying means corresponding to the relative positions of the platform means and the panel closing means.

37. Apparatus in accordance with claim 36 including:

means for cooling the heated and sealed end of the carton while it remains supported by the platform means; and means for selectively establishing by relative movement between the carton supporting platform means and the cooling means at least two discrete relative positions of the platform means and the cooling means corresponding to the relative positions of the platform means and the heat applying means.

* * * * *

UNITED STATES PATENT AND TRADEMARK OFFICE

CERTIFICATE OF CORRECTION

PATENT NO. : 4037370

DATED : July 26,1977

INVENTOR(S) : E. Alan Williams

It is certified that error appears in the above-identified patent and that said Letters Patent are hereby corrected as shown below:

Col 8, Line 26 - "closk" should be --clock--
Col 10, Line 40 - insert -- arms -- after hinge
Col 11, Line 6 - "200"should be --220--
Col 13, Line 19 - "tranversely" should be --transversely--
Col 15, Line 20 - "four square inches" should be --four inches square--
Col 18, Line 22 - "coolin" should be --cooling--
Col 19, Line 67 - "and" should be --the--
Col 20, Line 47 - first occurrence of "left" should be --right--
Col 21, Line 49 - "82" should be --482--
Col 21, Line 52 - "321" should be --32--
Col 23, Line 12 - "carbon" should be --carton--
Col 28, Line 22 - "is" should be --in--
Col 28, Line 27 - "memfber" should be --member--
Col 28, Line 61 - "controlling" should be --controllably--
Col 29, Line 4 - "carbon" should be --carton--

Col 29, Line 38 - "operationn" should be --operation--
Col 29, Line 63 - "stationary" should be --stationarily--
Col 30, Line 24 - "if" should be --is--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*